US010353308B2

(12) United States Patent
Hatakeyama et al.

(10) Patent No.: US 10,353,308 B2
(45) Date of Patent: Jul. 16, 2019

(54) TONER

(71) Applicant: CANON KABUSHIKI KAISHA, Tokyo (JP)

(72) Inventors: Fumiya Hatakeyama, Kawasaki (JP); Kunihiko Nakamura, Gotemba (JP); Kenta Kamikura, Yokohama (JP); Maho Tanaka, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/974,928

(22) Filed: May 9, 2018

(65) Prior Publication Data

US 2018/0329325 A1 Nov. 15, 2018

(30) Foreign Application Priority Data

May 15, 2017 (JP) ..... 2017-096222

(51) Int. Cl.
*G03G 9/08* (2006.01)
*G03G 9/093* (2006.01)
(Continued)

(52) U.S. Cl.
CPC ..... *G03G 9/0825* (2013.01); *G03G 9/0819* (2013.01); *G03G 9/08708* (2013.01);
(Continued)

(58) Field of Classification Search
CPC ..... G03G 9/08797; G03G 9/09307; G03G 9/09328
See application file for complete search history.

(56) References Cited

U.S. PATENT DOCUMENTS 7,858,283 B2 12/2010 Ishigami et al.
7,927,775 B2 4/2011 Komatsu et al.
(Continued)

FOREIGN PATENT DOCUMENTS

JP H08-292599 11/1996
JP 2009-036980 2/2009
(Continued)

OTHER PUBLICATIONS

Translation of KR 1020140072439.*
(Continued)

*Primary Examiner* — Peter L Vajda
(74) *Attorney, Agent, or Firm* — Venable LLP

(57) ABSTRACT

Provided is a toner, including a toner particle containing a toner base particle and a fine particle, wherein the fine particle includes a composite particle each having a surface covered with a condensation product of at least one kind of organosilicon compound selected from the group consisting of a compound represented by the following formula (1) and a compound represented by the following formula (2), wherein the fine particle is stuck in a state of being embedded in a surface of the toner base particle, and wherein a coverage of a composition containing the organosilicon compound with respect to the surface of the toner base particle excluding the fine particle is 0.1% by area or more and 40.0% by area or less:

Formula (1)

Formula (2)

5 Claims, 2 Drawing Sheets

(51) Int. Cl.
*G03G 9/087* (2006.01)
*G03G 9/097* (2006.01)

(52) U.S. Cl.
CPC ..... *G03G 9/08773* (2013.01); *G03G 9/09328* (2013.01); *G03G 9/09716* (2013.01); *G03G 9/09733* (2013.01)

(56) References Cited

U.S. PATENT DOCUMENTS

| | | | |
|---|---|---|---|
| 7,939,233 | B2 | 5/2011 | Inoue et al. |
| 8,043,781 | B2 | 10/2011 | Imafuku et al. |
| 8,137,886 | B2 | 3/2012 | Baba et al. |
| 8,142,972 | B2 | 3/2012 | Hotta et al. |
| 8,288,069 | B2 | 10/2012 | Fujikawa et al. |
| 8,828,639 | B2 | 9/2014 | Kamikura et al. |
| 8,986,914 | B2 | 3/2015 | Fujikawa et al. |
| 9,034,549 | B2 | 5/2015 | Shiotari et al. |
| 9,261,806 | B2 | 2/2016 | Moribe et al. |
| 9,285,697 | B2 | 3/2016 | Fukudome et al. |
| 9,298,116 | B2 | 3/2016 | Maetani et al. |
| 9,423,708 | B2 | 8/2016 | Tominaga et al. |
| 9,594,323 | B2 | 3/2017 | Fujikawa et al. |
| 9,645,518 | B2 | 5/2017 | Abe et al. |
| 9,829,820 | B2 | 11/2017 | Masumoto et al. |
| 9,880,478 | B2 | 1/2018 | Shimano et al. |
| 9,897,933 | B2 | 2/2018 | Yoshida et al. |
| 9,921,501 | B2 | 3/2018 | Mochizuki et al. |
| 9,952,523 | B2 | 4/2018 | Shimano et al. |
| 2009/0246675 | A1 | 10/2009 | Nakamura et al. |
| 2010/0028796 | A1 | 2/2010 | Nakamura et al. |
| 2010/0183971 | A1 | 7/2010 | Fujikawa et al. |

FOREIGN PATENT DOCUMENTS

| | | | |
|---|---|---|---|
| JP | 2015-106023 | | 6/2015 |
| JP | 2016-027399 | | 2/2016 |
| KR | 1020140072439 | * | 6/2014 |

OTHER PUBLICATIONS

U.S. Appl. No. 15/969,318, filed May 2, 2008, Tsuneyoshi Tominaga.
U.S. Appl. No. 15/973,661, filed May 8, 2018, Kenta Kamikura.
U.S. Appl. No. 15/974,187, filed May 8, 2018, Sara Yoshida.
U.S. Appl. No. 15/974,917, filed May 9, 2018, Kunihiko Nakamura.
U.S. Appl. No. 15/974,936, filed May 9, 2018, Kenta Kamikura.
U.S. Appl. No. 15/974,969, filed May 9, 2018, Maho Tanaka.
U.S. Appl. No. 15/975,064, filed May 9, 2018, Kunihiko Nakamura.
U.S. Appl. No. 15/975,305, filed May 9, 2018, Kentaro Yamawaki.

* cited by examiner

TONER

BACKGROUND OF THE INVENTION

Field of the Invention

The present disclosure relates to a toner for developing an electrostatic image (electrostatic latent image) to be used in image forming methods, such as electrophotography and electrostatic printing.

Description of the Related Art

In recent years, along with the development of computers and multimedia, a unit for outputting a high-definition full-color image has been desired in a wide variety of fields ranging from an office to a house, and hence a further improvement in performance of toner has been required. In particular, many investigations have been conducted on the following for the purpose of reducing adhesive forces between a toner particle and another toner particle, and between a toner particle and a developing member to improve the fluidity and transferability of the toner, and to improve the heat resistance thereof. Fine particles are caused to adhere to, or are embedded in, the surfaces of the toner particles.

In Japanese Patent Application Laid-Open No. 2009-036980, there is a disclosure of a toner in which fine particles are embedded in the surface of a toner particle to form protrusions.

In Japanese Patent Application Laid-Open No. 2015-106023, there is a disclosure of a toner in which fine particles are caused to adhere to the surface of a toner core, and then the surface is covered with a thermosetting resin for the purpose of improving the sticking properties of protrusions.

In Japanese Patent Application Laid-Open No. H08-292599, there is a disclosure of a toner in which adhesive forces between a toner particle and another toner particle, and between a toner particle and a developing member are reduced by covering the outermost surface layer of each toner particle with the coating film of a silane coupling agent.

The fluidity and transferability of the toner of Japanese Patent Application Laid-Open No. 2009-036980 were satisfactory at an initial stage because the protrusions of the fine particles were formed in the surface of the toner particle. However, after multi-sheet printing, the fluidity and the transferability reduced in some cases. This is probably because the fixation, i.e., sticking of the protrusions to the surface of the toner particle was insufficient, and hence the fine particles were detached during the multi-sheet printing.

The toner of Japanese Patent Application Laid-Open No. 2015-106023 was improved in transferability as compared to a toner in which no organic fine particle were caused to adhere to a toner particle, but a reduction in image density was observed after multi-sheet printing. This is probably because the sticking properties of the protrusions were not sufficiently improved by the thermosetting resin.

The toner of Japanese Patent Application Laid-Open No. H08-292599 was improved in initial transfer efficiency, but when the toner was used for a long time period, inorganic fine particles stuck to a surface of a toner particle were detached to reduce the transferability of the toner in some cases. In addition, the fixability of the toner reduced in some cases because the entirety of the toner particle was covered with the silane coupling agent.

As described above, the sticking of fine particles to the surface of a toner particle has heretofore been performed for reducing adhesive forces between a toner particle and another toner particle, and between a toner particle and a developing member to improve the fluidity and transferability of toner, but it has been difficult to achieve the maintenance of the stuck state throughout multi-sheet printing.

The present disclosure has been made in view of the problems, and an object of the present disclosure is to provide a toner that has satisfactory fluidity and satisfactory transferability while securing fixability, and that hardly deteriorates even after multi-sheet printing.

SUMMARY OF THE INVENTION

The present inventors have made extensive investigations, and as a result, have found that the problems can be solved by the following construction.

That is, the present disclosure relates to a toner, including a toner particle containing a toner base particle and fine particles, wherein the fine particles include composite particles in each of which a surface of a core fine particle is covered with a condensation product of at least one kind of organosilicon compound selected from the group consisting of a compound represented by the following formula (1) and a compound represented by the following formula (2), wherein the fine particles are stuck in a state of being embedded in a surface of the toner base particle, and wherein a coverage of the condensation product of the at least one kind of organosilicon compound with respect to the surface of the toner base particle excluding the fine particle is 0.1% by area or more and 40.0% by area or less:

Formula (1)

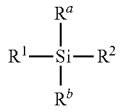

Formula (2)

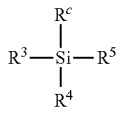

in the formulae (1) and (2), $R^a$, $R^b$, and $R^c$ each independently represent an alkyl group, an alkenyl group, an acetoxy group, an acyl group, an aryl group, a acryloxyalkyl group, or a methacryloxyalkyl group, and $R^1$, $R^2$, $R^3$, $R^4$, and $R^5$ each independently represent a halogen atom, a hydroxy group, or an alkoxy group.

Further features of the present disclosure will become apparent from the following description of exemplary embodiments with reference to the attached drawings.

BRIEF DESCRIPTION OF THE DRAWINGS

FIG. 3A, FIG. 3B, and FIG. 3C are image examples used in the calculation of a coverage, in which FIG. 3A is a backscattered electron image example of the toner particle of the present disclosure, FIG. 3B is an image after the binary processing of the backscattered electron image of FIG. 3A, and FIG. 3C is an image after the removal of a portion derived from a silica particle from the image of FIG. 3B.

DESCRIPTION OF THE EMBODIMENTS

Preferred embodiments of the present disclosure will now be described in detail in accordance with the accompanying drawings.

A toner of the present disclosure is a toner, including a toner particle containing a toner base particle and fine particles, wherein the fine particles include composite particles in each of which a surface of a core fine particle is covered with a condensation product of at least one kind of organosilicon compound selected from the group consisting of a compound represented by the following formula (1) and a compound represented by the following formula (2), wherein the fine particles are stuck in a state of being embedded in a surface of the toner base particle, and wherein a coverage of the condensation product of the at least one kind of organosilicon compound with respect to the surface of the toner base particle excluding the fine particle is 0.1% by area or more and 40.0% by area or less:

Formula (1)

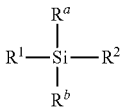

Formula (2)

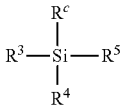

in the formulae (1) and (2), $R^a$, $R^b$, and $R^c$ each independently represent an alkyl group, an alkenyl group, an acetoxy group, an acyl group, an aryl group, a acryloxyalkyl group, or a methacryloxyalkyl group, and $R^1$, $R^2$, $R^3$, $R^4$, and $R^5$ each independently represent a halogen atom, a hydroxy group, or an alkoxy group.

The outline of the present disclosure is described below.

Figure 1:
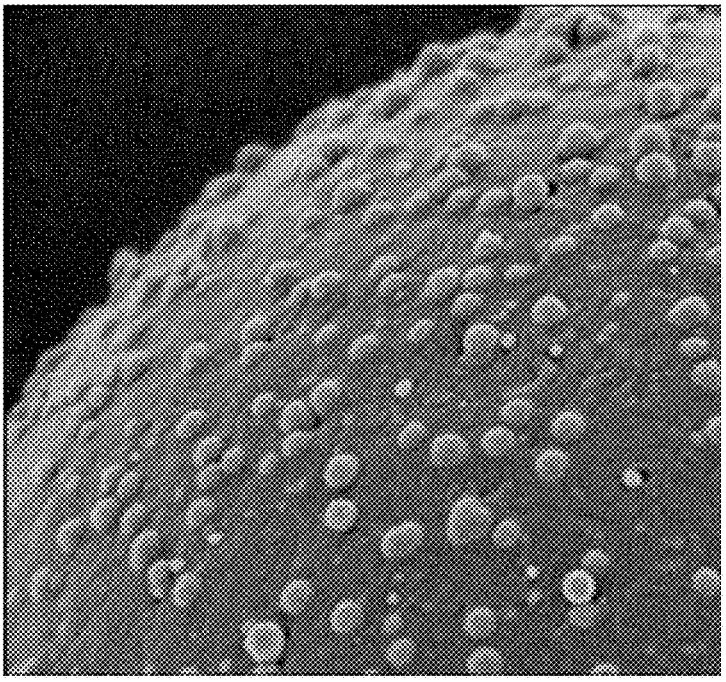
FIG. 1 is an image example for showing the surface of a toner particle of the present disclosure.
Figure 2:
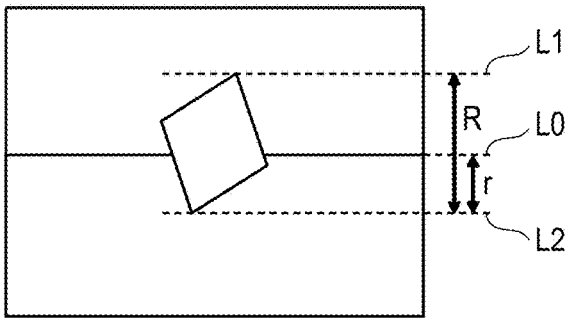
FIG. 2 is a schematic view for illustrating a method of calculating an embedment ratio.

FIG. 1 is an electron microscope photograph of the toner particle of the present disclosure, and the following situation is shown in the photograph: the fine particles are stuck in a state of being embedded in the surface of the toner base particle. Here, the "embedded state" of the fine particles in the present disclosure refers to a state in which an "embedment ratio" calculated from a diameter R of each of the fine particles and an embedment length r of the fine particle is 20% or more (FIG. 2). In the case where the fine particles are embedded in the toner base particle, a contact area between the fine particles and the toner base particle becomes larger than that in the case where the fine particles adhere onto the toner base particle. Accordingly, an adhesive force between the toner base particle and each of the fine particles becomes larger, and hence the fine particles are more hardly detached. In addition, the embedment ratio is preferably 20% or more and 80% or less in order that sufficient fluidity and sufficient transferability may be imparted to the toner particle.

The fine particle is a composite particle in which the surface of the core fine particle is covered with the condensation product of at least one kind of organosilicon compound selected from the group consisting of the compound represented by the formula (1) (hereinafter also called "the organosilicon compound represented by the formula (1)") and the compound represented by the formula (2) (hereinafter also called "the organosilicon compound represented by the formula (2)"). The condensation product of the organosilicon compound has two functions, that is, a function of covering the surface of the core fine particle and a function of being stuck to the toner base particle.

In order to achieve print quality that does not change even at the time of multi-sheet printing, the toner is required to have such durability that the surface of the toner particle hardly deteriorates even after the multi-sheet printing. In order to achieve the durability, the surfaces of the fine particles present on the surface of the toner particle need to be hard. The present inventors have found that it is difficult to achieve the hardness with an organic resin, and the organosilicon compound represented by the formula (1) and the organosilicon compound represented by the formula (2) each of which can provide a condensation product belonging to an inorganic compound, the condensation product using a siloxane bond (—Si—O—Si—) as a main skeleton and having a moderate crosslinked structure, are suitable for the achievement.

In addition, in a mixing step of embedding the fine particles in the toner base particle with a mechanical impact force, the step having been conventionally performed, the fine particles were detached from the toner base particle at the time of multi-sheet printing in some cases. The present inventors have made extensive investigations, and as a result, have found that a sticking strength between the toner base particle and each of the fine particles is improved by covering the core fine particles, and at the same time, bonding the fine particles to the toner base particle when an organosilicon compound condensate is a low-molecular weight body, and then increasing the condensation degree of the condensation product of the organosilicon compound.

This is probably because of the following reason: in the case of the embedment with the mechanical impact force, the fine particles and part of the toner base particle are in a state of being in contact with each other; meanwhile, such a low-molecular weight organosilicon compound condensation product as to be obtained from the compound represented by the following formula (1) and the compound represented by the following formula (2) has high flexibility, and hence can widen the contact area between the fine particles and the toner base particle through wetting, in other words, serves as one kind of adhesive. The organosilicon compound represented by the formula (2) is more preferred because the crosslinked structure can be easily formed.

Formula (1)

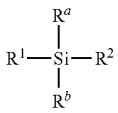

Formula (2)

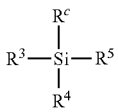

In the formulae (1) and (2), $R^a$, $R^b$, and $R^c$ each independently represent an alkyl group having preferably 1 or more and 10 or less (more preferably 1 or more and 6 or less) carbon atoms, an alkenyl group having preferably 2 or more and 6 or less (more preferably 2 or more and 4 or less) carbon atoms, an acetoxy group, an acyl group having preferably 2 or more and 6 or less (more preferably 2 or more and 4 or less) carbon atoms, an aryl group having preferably 6 or more and 14 or less (more preferably 6 or more and 10 or less) carbon atoms, a acryloxyalkyl group having preferably 1 or more and 6 or less (more preferably 1 or more and 4 or less) carbon atoms or a methacryloxyalkyl group having preferably 1 or more and 6 or less (more preferably 1 or more and 4 or less) carbon atoms. $R^1$, $R^2$, $R^3$, $R^4$, and $R^5$ each independently represent a halogen atom, a hydroxy group, or an alkoxy group having preferably 1 or more and 10 or less (more preferably 1 or more and 6 or less) carbon atoms.

Examples of the organosilicon compound represented by the formula (1) include difunctional silane compounds, such as dimethyldimethoxysilane and dimethyldiethoxysilane.

Examples of the organosilicon compound represented by the formula (2) include the following:

trifunctional methylsilanes, such as methyltrimethoxysilane, methyltriethoxysilane, methyldiethoxymethoxysilane, and methylethoxy dimethoxysilane;

trifunctional silane compounds, such as ethyltrimethoxysilane, ethyltriethoxysilane, propyltrimethoxysilane, propyltriethoxysilane, butyltrimethoxysilane, butyltriethoxysilane, hexyltrimethoxysilane, and hexyltriethoxysilane;

trifunctional phenylsilanes, such as phenyltrimethoxysilane and phenyltriethoxysilane;

trifunctional vinylsilanes, such as vinyltrimethoxysilane and vinyltriethoxysilane;

trifunctional allylsilanes, such as allyltrimethoxysilane, allyltriethoxysilane, allyldiethoxymethoxysilane, and allylethoxydimethoxysilane;

trifunctional γ-acryloxyalkylsilanes, such as γ-acryloxypropyltrimethoxysilane, γ-acryloxypropyltriethoxysilane, γ-acryloxypropyldiethoxymethoxysilane, and γ-acryloxypropylethoxydimethoxysilane; and trifunctional γ-methacryloxyalkylsilanes, such as γ-methacryloxypropyltrimethoxysilane, γ-methacryloxypropyltriethoxysilane, γ-methacryloxypropyldiethoxymethoxysilane, and γ-methacryloxypropylethoxydimethoxysilane.

In addition, a silane compound other than the silane compounds represented by the formulae (1) and (2) may be used in combination. Examples thereof include: monofunctional silane compounds, such as trimethylethoxysilane, triethylmethoxysilane, triethylethoxysilane, triisobutylmethoxysilane, triisopropylmethoxysilane, and tri-2-ethylhexylmethoxysilane; and tetrafunctional silane compounds, such as tetramethoxysilane, tetraethoxysilane, tetrapropoxysilane, and tetrabutoxysilane.

The content of the condensation product of the organosilicon compound is preferably 0.1 part by mass or more and 20.0 parts by mass or less with respect to 100 parts by mass of the toner base particle from the viewpoints of the ease with which a condensate is formed and the property by which the surfaces of the fine particles are covered. The content is more preferably 0.3 part by mass or more and 15.0 parts by mass or less.

The fine particle is a composite particle in which the surface of the core fine particle is covered with the condensation product of at least one kind of organosilicon compound selected from the group consisting of the compound represented by the formula (1) and the compound represented by the formula (2). When the fine particle is the composite particle, the fine particle can be stuck to the toner base particle while its hardness is secured.

A method of producing the fine particle, which is not particularly limited, is, for example, a method involving adding the organosilicon compound under a state in which the core fine particles and the toner base particle are caused to coexist in an aqueous medium to condense the compound. The method is preferred because the condensation product of the organosilicon compound covers not only the surfaces of the core fine particles but also part of the toner base particle.

The organosilicon compound is added to the aqueous medium by an arbitrary method. For example, the following methods are available: the organosilicon compound is added as it is; and in the case of an organosilicon compound, such as an alkoxysilane, the compound is mixed with the aqueous medium to be hydrolyzed, and then the hydrolysate is added to the aqueous medium having the core fine particles and the toner base particle.

The condensation reaction of the organosilicon compound, such as an alkoxysilane, occurs after its hydrolysis. The two reactions are different from each other in optimum pH, and hence the following procedure is preferred because a reaction time can be shortened: the organosilicon compound is mixed with the aqueous medium in advance and hydrolyzed at such a pH that its hydrolysis reaction rapidly advances, and then the hydrolysate is added to the aqueous medium having the core fine particles and the toner base particle.

In the present disclosure, a core fine particles having a number-average particle diameter of 30 nm or more and 500 nm or less are preferably used because protrusions based on the fine particles are formed in the surface of the toner particle, and the sticking strength between the toner base particle and each of the fine particles can be improved. The number-average particle diameter of the core fine particles is more preferably 30 nm or more and 300 nm or less, still more preferably 50 nm or more and 200 nm or less. The adoption of the particle diameter can improve the transferability and fluidity of the produced toner.

The core fine particles are not particularly limited, and examples thereof include: inorganic fine particles, such as silica, titania, alumina, and hydrotalcite; and polymer-based resin fine particles, such as a polymethyl acrylate resin, a polymethyl methacrylate resin, a urethane resin, a phenol resin, and a polystyrene resin. Of those, inorganic fine particles are preferred. The inorganic fine particles can improve the durability of the toner against multi-sheet printing because the fine particles themselves each have high hardness. In addition, the inorganic fine particles are preferred because each of the fine particles has high reactivity with the organosilicon compound, and hence a strong layer containing the condensation product of the organosilicon compound can be produced on its surface.

In particular, silica is more preferred because silica strongly reacts with the condensation product of the organosilicon compound.

The content of the core fine particles is preferably 0.1 part by mass or more and 10.0 parts by mass or less with respect to 100 parts by mass of the toner base particle because both the fluidity and transferability of the toner, and the fixability thereof can be achieved. The content is more preferably 0.3 part by mass or more and 7.0 parts by mass or less, still more preferably 0.5 part by mass or more and 5.0 parts by mass or less.

In the present disclosure, at least part of the surface of the toner base particle excluding the fine particles is covered with the condensation product of the organosilicon compound. In order to impart fluidity and transferability to the toner, an adhesive force between the toner particles needs to be reduced by covering the toner base particle with the condensation product. In the case where the condensation product of the organosilicon compound covers the toner base particle, unlike the case where the toner base particle is covered with, for example, an external additive having a small particle diameter, a covering portion is in surface contact with the toner base particle, and hence the covering portion hardly peels and the low adhesive force between the toner particles can be maintained even after multi-sheet printing.

The coverage of the condensation product of the organosilicon compound with respect to the surface of the toner base particle excluding the fine particles is 0.1% by area or more and 40.0% by area or less. When the coverage falls within the range, both the fixability of the toner and the sticking properties of the fine particles to the toner base particle can be achieved. The coverage is preferably 1.0% by area or more and 35.0% by area or less, more preferably 2.0% by area or more and 30.0% by area or less.

The coverage can be calculated from an image obtained by subjecting a backscattered electron image of a SEM to binary processing. Details about a calculation procedure are described later.

In addition, the thickness of the condensation product of the organosilicon compound of the portion covering the toner base particle is preferably 10 nm or less. When the thickness is 10 nm or less, the ease with which a binder resin or the like in the toner base particle exudes at the time of the fixation of the toner is not inhibited, and hence the fixability of the toner is not impaired. Whether or not the thickness is 10 nm or less can be confirmed by the Si element mapping of a TEM-EDX image of a section of one particle of the toner.

In addition, in the present disclosure, two or more kinds of fine particles may be used. When the two or more kinds of fine particles are used in combination, the respective fine particles can impart different functions to the toner. For example, when fine particles having different particle diameters are used in combination, the fluidity of the toner can be improved by fine particles having small particle diameters, and the transferability thereof can be improved by fine particles having large particle diameters. Alternatively, fine particles different from each other in constituent material, surface state, or particle shape may be used in combination. As long as the fine particles of one kind satisfy the requirements of the present disclosure, the fine particles of the other kind may be fine particles that do not satisfy the requirements of the present disclosure.

In addition, it is preferred that the toner base particle contain a binder resin, and that in the case where, in heating IR measurement of the toner base particle in the range of from 25° C. to 100° C., a peak intensity derived from the binder resin at 25° C. is represented by $I_0$, a maximum value of the peak intensity derived from the binder resin is represented by $I_{MAX}$, and a temperature at an intensity $I_{10\%}$ at which the peak intensity derived from the binder resin becomes 10% with respect to the $I_{MAX}$ is represented by $T_1$, and a peak intensity derived from the binder resin at the temperature $T_1$ when the toner is similarly subjected to heating IR measurement is represented by $I_{T1}$, the $I_0$, the $I_{MAX}$, and the $I_{10\%}$ satisfy the following expression.

$$50 \geq (I_{T1}-I_0)/(I_{10\%}-I_0)\times 100$$

The heating IR measurement can provide information about the exudation of the internal components of the toner base particle typified by the binder resin. In the case of, for example, a toner in which the toner base particle is covered with a component for inhibiting the exudation of the binder resin, the temperature at which the peak intensity derived from the binder resin increases shifts to a temperature higher than the result of the heating IR measurement of the toner base particle performed under the same condition. That is, a state in which the $I_{T1}$ of the toner is closer to a value for the $I_{10\%}$ of the toner base particle means that an exudation property obtained from the information is closer to the exudation property of the binder resin of the toner base particle alone.

A case in which the expression is satisfied is preferred because the exudation of the binder resin at the time of the fixation is not inhibited, and hence the fixability of the toner base particle is not impaired. In addition, when the exudation of the binder resin is accelerated by the fine particles or the condensation product, the ratio of the $I_{T1}$ (value for the left-hand side of the expression) may be more than 100(%). The ratio of the $I_{T1}$ is more preferably 65(%) or more, still more preferably 75(%) or more.

A method of producing the toner base particle is not particularly limited, and a suspension polymerization method, a dissolution suspension method, an emulsion aggregation method, a pulverization method, or the like can be used. When the toner base particle is produced in the aqueous medium, the aqueous dispersion liquid of the toner base particle may be used as it is in the next step of sticking the fine particles, or may be redispersed in the aqueous medium after having been washed, filtered, and dried. When the toner base particle is produced by a dry process, the aqueous dispersion liquid of the toner base particle can be obtained through the dispersion of the toner base particle in the aqueous medium by a known method. In order to disperse the toner base particle in the aqueous medium, the aqueous medium preferably contains a dispersion stabilizer.

The suspension polymerization method is described as an example of a method of producing the toner base particle.

When the toner base particle is obtained by the suspension polymerization method, a polymerizable monomer composition is prepared by: adding a polymerizable monomer that can produce the binder resin, and as required, an additive, such as a colorant; and melting, dissolving, or dispersing the materials with a dispersing machine. At this time, a release agent, a charge control agent, a solvent for viscosity adjustment, a crystalline resin, a plasticizer, a chain transfer agent, or any other additive can be appropriately added as an additive to the polymerizable monomer composition as required. Examples of the dispersing machine include a homogenizer, a ball mill, a colloid mill, and an ultrasonic dispersing machine.

Next, the polymerizable monomer composition is loaded into an aqueous medium containing poorly water-soluble inorganic fine particles prepared in advance, and a suspension is prepared by granulating the mixture with a high-speed dispersing machine, such as a high-speed stirring machine or an ultrasonic dispersing machine (granulation step).

After that, the polymerizable monomer in the suspension is polymerized to provide the toner base particle (polymerization step). In the polymerization step, a polymerization initiator may be mixed together with any other additive at the time of the preparation of the polymerizable monomer composition, or may be mixed into the polymerizable monomer composition immediately before being suspended in the aqueous medium. In addition, during the granulation or after the completion of the granulation, that is, immediately before the initiation of the polymerization reaction, the initiator can be added in a state of being dissolved in the polymerizable monomer or any other solvent as required.

After that, desolvation treatment is performed as required. Thus, the aqueous dispersion liquid of the toner base particle is obtained.

(Step of Sticking Fine Particles)

Next, the organosilicon compound represented by the formula (1) and the organosilicon compound represented by the formula (2) are hydrolyzed in the aqueous medium. Thus, an aqueous medium having the hydrolysates of the organosilicon compounds is obtained. Then, the aqueous medium having the hydrolysates of the organosilicon compounds and the core fine particles are mixed with the aqueous dispersion liquid containing the toner base particle. Thus, a mixed liquid is obtained. The resultant mixed liquid is stirred while its pH is preferably adjusted to 3.0 or more and 8.0 or less.

Next, the pH of the mixed liquid is preferably set to 7.0 or more and 12.0 or less, and the organosilicon compounds are condensed. Thus, the toner particles are obtained. A temperature at the time of the condensation, which is not particularly limited, is preferably the glass transition temperature (Tg) of the toner base particle or more and 105° C. or less because the condensation rate of each of the organosilicon compounds can be increased while the sticking of the core fine particles is accelerated. Through the foregoing steps, the fine particles can be stuck in a state of being embedded in the surface of the toner base particle while the surface of each of the core fine particles is covered with the organosilicon compounds.

The timing at which the aqueous medium having the hydrolysates of the organosilicon compounds is mixed with the toner base particle may be any one of the following timings: immediately after the granulation step (in other words, before the polymerization step); during the polymerization step; and after the completion of the polymerization step. In addition, the aqueous medium may be added in portions to the aqueous dispersion liquid at a plurality of timings. When the polymerizable monomer composition (toner particle precursor), the aqueous medium having the hydrolysates of the organosilicon compounds, and the core fine particles are mixed immediately after the granulation step (before the polymerization step), the polymerization step can be performed after the pH of the resultant mixed liquid has been preferably adjusted to 3.0 or more and 8.0 or less.

After the condensation of the organosilicon compounds, the resultant is washed as required, and is dried and classified by various methods. Thus, the toner particles can be obtained.

Next, constituent materials for the toner particle are described.

(Colorant)

A colorant may be used in the toner particle. A pigment can be used as the colorant. For example, a black pigment, a yellow pigment, a magenta pigment, or a cyan pigment listed below is used as the pigment.

An example of the black pigment is carbon black.

Examples of the yellow pigment include: a monoazo compound; a disazo compound; a condensed azo compound; an isoindolinone compound; an isoindoline compound; a benzimidazolone compound; an anthraquinone compound; an azo metal complex; a methine compound; and an arylamide compound. A specific example thereof is C.I. Pigment Yellow 74, 93, 95, 109, 111, 128, 155, 174, 180, or 185.

Examples of the magenta pigment include: a monoazo compound; a condensed azo compound; a diketopyrrolopyrrole compound; an anthraquinone compound; a quinacridone compound; a basic dye lake compound; a naphthol compound; a benzimidazolone compound; a thioindigo compound; and a perylene compound. Specific examples thereof include: C.I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, or 269; and C.I. Pigment Violet 19.

Examples of the cyan pigment include: a copper phthalocyanine compound and a derivative thereof; an anthraquinone compound; and a basic dye lake compound. A specific example thereof is C.I. Pigment Blue 1, 7, 15, 15:1, 15:2, 15:3, 15:4, 60, 62, or 66.

In addition, various dyes that have heretofore been known as colorants may be used in combination with the pigments.

The content of the pigment is preferably 1.0 part by mass or more and 20.0 parts by mass or less with respect to 100.0 parts by mass of a binder resin.

(Binder Resin)

The toner base particle contains the binder resin. Examples of the binder resin include a vinyl-based resin, a polyester resin, a polyamide resin, a furan resin, an epoxy resin, a xylene resin, and a silicon resin. Of those, a vinyl-based resin is preferably used. A polymer or a copolymer of such a monomer as described below can be used as the vinyl-based resin: a styrene-based monomer, such as styrene or α-methylstyrene; an unsaturated carboxylate, such as methyl acrylate, butyl acrylate, methyl methacrylate, 2-hydroxyethyl methacrylate, t-butyl methacrylate, or 2-ethylhexyl methacrylate; an unsaturated carboxylic acid, such as acrylic acid or methacrylic acid; an unsaturated dicarboxylic acid, such as maleic acid; an unsaturated dicarboxylic acid anhydride, such as maleic anhydride; a nitrile-based vinyl monomer, such as acrylonitrile; a halogen-containing vinyl monomer, such as vinyl chloride; or a nitro-based vinyl monomer, such as nitrostyrene. Those monomers can each be used as the polymerizable monomer. Of those, a copolymer of a styrene-based monomer and an unsaturated carboxylate is preferably used.

(Wax)

A wax may be incorporated into the toner base particle. Examples of the wax include the following.

Examples thereof include: an ester of a monohydric alcohol and an aliphatic carboxylic acid, or an ester of a monovalent carboxylic acid and an aliphatic alcohol, such as behenyl behenate, stearyl stearate, or palmityl palmitate; an ester of a dihydric alcohol and an aliphatic carboxylic acid, or an ester of a divalent carboxylic acid and an aliphatic alcohol, such as dibehenyl sebacate or hexanediol dibehenate; an ester of a trihydric alcohol and an aliphatic carboxylic acid, or an ester of a trivalent carboxylic acid and an aliphatic alcohol, such as glycerin tribehenate; an ester of a tetrahydric alcohol and an aliphatic carboxylic acid, or an ester of a tetravalent carboxylic acid and an aliphatic alcohol, such as pentaerythritol tetrastearate or pentaerythritol tetrapalmitate; an ester of a hexahydric alcohol and an aliphatic carboxylic acid, or an ester of a hexavalent carboxylic acid and an aliphatic alcohol, such as dipentaerythritol hexastearate or dipentaerythritol hexapalmitate; an ester of a polyhydric alcohol and an aliphatic carboxylic acid, or an ester of a polyvalent carboxylic acid and an aliphatic alcohol, such as polyglycerin behenate; a natural ester wax, such as a carnauba wax or a rice bran wax; a petroleum-based wax or a derivative thereof, such as a paraffin wax, a microcrystalline wax, or petrolatum; a hydrocarbon wax or a derivative thereof produced by a Fischer-Tropsch method; a polyolefin wax or a derivative thereof, such as a polyethylene wax or a polypropylene wax; a higher aliphatic alcohol; a fatty acid, such as stearic acid or palmitic acid; and an acid amide wax.

In the toner of the present disclosure, various organic or inorganic fine powders may be externally added to the toner particles as required. For example, the following fine powder is used as the organic or inorganic fine powder.

(1) Fluidity imparting agents: silica, alumina, titanium oxide, carbon black, and carbon fluoride.

(2) Abrasives: metal oxides (such as strontium titanate, cerium oxide, alumina, magnesium oxide, and chromium oxide), nitrides (such as silicon nitride), carbides (such as silicon carbide), and metal salts (such as calcium sulfate, barium sulfate, and calcium carbonate).

(3) Lubricants: fluorine-based resin powders (such as vinylidene fluoride and polytetrafluoroethylene) and fatty acid metal salts (such as zinc stearate and calcium stearate).

(4) Charge controllable particles: metal oxides (such as tin oxide, titanium oxide, zinc oxide, silica, and alumina) and carbon black.

The organic or inorganic fine powder may be used after its surface has been treated in order to improve the fluidity of the toner and to uniformize the charging of the toner. As a treatment agent for hydrophobic treatment, there are given an unmodified silicon varnish, various modified silicon varnishes, an unmodified silicon oil, various modified silicon oils, a silane compound, a silane coupling agent, other organosilicon compounds, and an organotitanium compound. Those treatment agents may be used alone or in combination thereof.

Measurement methods for physical property values specified in the present disclosure are described below.

<Particle Diameter of Toner Base Particle>

The weight-average particle diameter (D4) of the toner base particles is calculated as described below. A precision particle size distribution measuring apparatus based on a pore electrical resistance method provided with a 100 μm aperture tube "Coulter Counter Multisizer 3" (trademark, manufactured by Beckman Coulter, Inc.) is used as a measuring apparatus. Dedicated software included therewith "Beckman Coulter Multisizer 3 Version 3.51" (manufactured by Beckman Coulter, Inc.) is used for setting measurement conditions and analyzing measurement data. The measurement is performed with the number of effective measurement channels of 25,000.

An electrolyte aqueous solution prepared by dissolving reagent grade sodium chloride in ion-exchanged water so as to have a concentration of 1%, for example, "ISOTON II" (manufactured by Beckman Coulter, Inc.) can be used in the measurement.

The dedicated software was set as described below prior to the measurement and the analysis.

In the "Change Standard Operating Method (SOMME)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value. A threshold and a noise level are automatically set by pressing a "Threshold/Measure Noise Level button". In addition, a current is set to 1,600 μA, a gain is set to 2, and an electrolyte solution is set to ISOTON II, and a check mark is placed in a check box "Flush Aperture Tube after Each Run."

In the "Convert Pulses to Size Settings" screen of the dedicated software, a bin spacing is set to a logarithmic particle diameter, the number of particle diameter bins is set to 256, and a particle diameter range is set to the range of from 2 μm to 60 μm.

A specific measurement method is as described below.

(1) 200 mL of the electrolyte aqueous solution is charged into a 250-milliliter round-bottom beaker made of glass dedicated for Multisizer 3. The beaker is set in a sample stand, and the electrolyte aqueous solution in the beaker is stirred with a stirrer rod at 24 rotations/sec in a counter-clockwise direction. Then, dirt and bubbles in the aperture tube are removed by the "Flush Aperture" function of the dedicated software.

(2) 30 mL of the electrolyte aqueous solution is charged into a 100-milliliter flat-bottom beaker made of glass. 0.3 mL of a diluted solution obtained by diluting "Contaminon N" (10% aqueous solution of a neutral detergent for washing a precision measuring unit formed of a nonionic surfactant, an anionic surfactant, and an organic builder, and having a pH of 7, manufactured by Wako Pure Chemical Industries, Ltd.) with ion-exchanged water by three fold in terms of a mass ratio is added as a dispersant to the electrolyte aqueous solution.

(3) An ultrasonic dispersing unit "Ultrasonic Dispersion System Tetra 150" (manufactured by Nikkaki Bios Co., Ltd.) in which two oscillators each having an oscillatory frequency of 50 kHz are built so as to be out of phase by 180°, and which has an electrical output of 120 W is prepared. 3.3 L of ion-exchanged water is charged into the water tank of the ultrasonic dispersing unit. 2 mL of the Contaminon N is charged into the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte aqueous solution in the beaker may resonate with an ultrasonic wave from the ultrasonic dispersing unit to the fullest extent possible.

(5) 10 mg of the toner base particles are gradually added to and dispersed in the electrolyte aqueous solution in the beaker in the section (4) under a state in which the electrolyte aqueous solution is irradiated with the ultrasonic wave. Then, the ultrasonic dispersion treatment is continued for an additional 60 seconds. The temperature of water in the water tank is appropriately adjusted so as to be 10° C. or more and 40° C. or less in the ultrasonic dispersion.

(6) The electrolyte aqueous solution in the section (5) in which the toner base particles have been dispersed is dropped with a pipette to the round-bottom beaker in the section (1) placed in the sample stand, and the concentration of the toner base particles to be measured is adjusted to 5%. Then, measurement is performed until the particle diameters of 50,000 particles are measured.

(7) The measurement data is analyzed with the dedicated software included with the apparatus, and the weight-average particle diameter (D4) is calculated. The "Average Diameter" on the "Analysis/Volume Statistics (Arithmetic Average)" screen of the dedicated software when the dedicated software is set to show a graph in a vol % unit is the weight-average particle diameter (D4).

<Embedment Judgment of Fine Particles>

The embedment ratio of the fine particles with respect to the toner base particle is calculated from the observation of a section of the toner base particle with a transmission electron microscope (TEM).

The toner is sufficiently dispersed in a visible light-curable embedding resin (product name: D-800, manufactured by Toagosei Co., Ltd.). After that, a cured product is obtained by irradiating the visible light-curable embedding resin with visible light through the use of a light irradiator (product name: LUXSPOT II, manufactured by JEOL Ltd.) to cure the resin. A flaky sample is cut out of the resultant cured product with a microtome including a diamond blade. The sample is enlarged at a magnification of 100,000 with a transmission electron microscope (TEM) (product name: JEM-2800, manufactured by JEOL Ltd.) at an acceleration voltage of 200 kV, and a section of one particle of toner is observed.

The embedment ratio is calculated from the resultant section image by the following procedure (FIG. 2 is a view for illustrating a procedure for the calculation of the embedment ratio of a fine particle from the section image.).

(1) The surface of the toner base particle is regarded as a straight line L0, and a straight line L1 parallel to the surface of the toner base particle, the line passing the highest point of the portion of the fine particle protruding from the toner base particle (protrusion), is drawn.

(2) A straight line L2 parallel to the surface of the toner base particle, the line passing the lowest point of the deepest portion of the embedded fine particle in the toner base particle, is drawn.

(3) A distance between the two straight lines L1 and L2 obtained in the (1) and the (2) is defined as a fine particle diameter "R".

(4) Next, a distance between the surface L0 of the toner base particle and the straight line L2 obtained in the (2) is defined as a fine particle embedment length "r".

(5) A value for (r/R×100) is defined as an embedment ratio [%] in one fine particle.

The operations are performed on 100 fine particles. The average of all the numerical values is calculated, and the resultant value is defined as the embedment ratio.

When the embedment ratio was 20% or more and less than 80%, it was judged that the fine particles were "embedded".

<Method of Measuring Coverage of Condensation Product of Organosilicon Compound with Respect to Surface of Toner Base Particle Excluding Fine Particles>

Figure 3A:
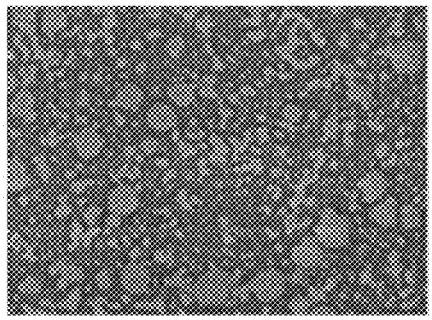
Figure 3B:
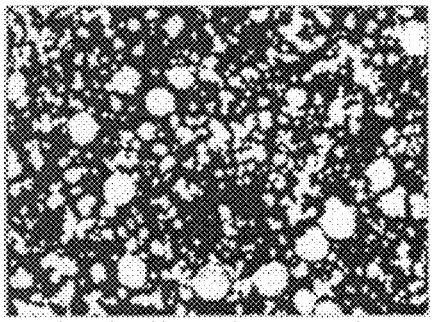

A state in which the surface of the toner particle is covered with the fine particles is observed with a scanning electron microscope (SEM) (product name: JSM-7800F, manufactured by JEOL Ltd.) (FIG. 3A is an example of a backscattered electron image of the toner particle taken with the scanning electron microscope).

Conditions for the observation with the JSM-7800F are as described below.

| | |
|---|---|
| Observation mode | GB |
| Incident voltage | 1.0 [kV] |
| Working distance (WD) | 2 [mm] |
| Detector | UED |
| Scan mode | CF1 |

One image was taken for one toner particle. The images were taken for 10 toner particles.

A coverage is calculated with an image processing analyzer (product name: LUZEX AP, manufactured by Nireco Corporation) by the following procedure.

Figure 3C:
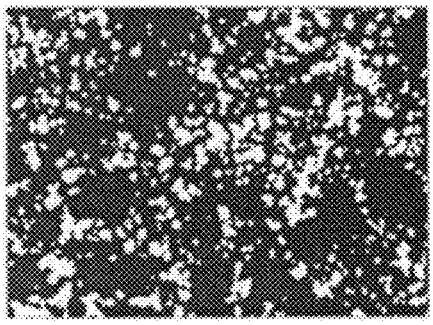

1. A "File" in an "Input/Output" tab is selected. A file to be subjected to image processing is selected.
2. A mask size "3×3" is selected from a "Space Filter" in a "Gray-scale Image Processing" tab. Linear "Average Processing" is performed twice.
3. Portions derived from the fine particles in an image are selected with a "Handwritten Correction" in a "Binary Image Processing" tab, and contrast is changed so that the portions derived from the fine particles may be removed. As a result, such an image as shown in FIG. 3C is obtained.
4. A "Measurement" in the "Binary Image Processing" tab is selected. A numerical value for the area ratio of the condensation product of the organosilicon compound with respect to the surface of the toner base particle is calculated, and the numerical value for the area ratio is defined as the coverage of the image.
5. The operations 1 to 4 are performed on 5 images, and the average of the resultant values is defined as the coverage of the condensation product of the organosilicon compound with respect to the surface of the toner base particle excluding the fine particles.

<Method of Confirming Thickness of Condensation Product of Organosilicon Compound Covering Toner Base Particle>

The thickness of the condensation product of the organosilicon compound present on the surface of the toner base particle excluding the fine particles is confirmed as described below.

First, the toner is sufficiently dispersed in a visible light-curable embedding resin (product name: D-800, manufactured by Toagosei Co., Ltd.). After that, a cured product is obtained by irradiating the visible light-curable embedding resin with visible light through the use of a light irradiator (product name: LUXSPOT II, manufactured by JEOL Ltd.) to cure the resin. A flaky sample is cut out of the resultant cured product with a microtome including a diamond blade. The sample is enlarged at a magnification of 100,000 with a transmission electron microscope (TEM) (product name: JEM-2800, manufactured by JEOL Ltd.) at an acceleration voltage of 200 kV, and a section of one particle of toner is observed.

Here, when silicon atom mapping is performed by utilizing energy-dispersive X-ray spectroscopy (EDX), it can be confirmed that the condensation product of the organosilicon compound is formed on the surface of the toner particle. Whether or not the thickness of the condensation product of the organosilicon compound present on the surface of the toner base particle excluding the fine particles was 10 nm or less was confirmed from the resultant silicon mapping image of the TEM image.

<Method of Measuring Ratio of $I_{T1}$ of Toner>

The heating IR measurement in the present disclosure was performed by mounting a heating unit (golden gate heating-type ATR apparatus, manufactured by Systems Engineering Inc.) on Frontier FT IR (manufactured by PerkinElmer, Inc.).

A sample was set in the heating unit, and the measurement was performed under the following conditions.

| | |
|---|---|
| Measurement temperature range | 25 to 100 [° C.] |
| Rate of temperature increase | 2 [° C./min] |
| IR measurement wave number range | 550 to 4,000 [$cm^{-1}$] |
| IR measurement ATR crystal | Diamond (KRS-5) |
| IR measurement interval | 1 [min] |

A peak optimum for each binder resin only needs to be selected as a peak derived from the binder resin.

For example, when the binder resin was a polystyrene-based resin, a peak derived from an aromatic ring around 700 $cm^{-1}$ was selected, and when the binder resin was a polyester-based resin, a peak derived from an ester bond around 1,750 $cm^{-1}$ was selected.

In the heating IR measurement of the toner base particle in the range of from 25° C. to 100° C., a peak intensity derived from the binder resin at 25° C. is represented by $I_0$, and the maximum value of the maximum peak intensity derived from the binder resin in the range of from 25° C. to 100° C. is represented by $I_{MAX}$.

Next, an intensity $I_{10\%}$ at which the peak intensity derived from the binder resin becomes 10% with respect to the $I_{MAX}$ is determined from the following equation.

$$I_{10\%}=(I_{MAX}-I_0)/10+I_0$$

Then, the temperature at which the peak intensity derived from the binder resin of the toner base particle exceeds the $I_{10\%}$ is represented by $T_1$.

Next, a peak intensity $I_{T1}$ at the temperature $T_1$ is determined by performing the heating IR measurement of the toner in the same manner as in the heating IR measurement of the toner base particle.

The ratio of the $I_{T1}$ of the toner to the $I_{10\%}$ of the toner base particle (ratio of the $I_{T1}$) is calculated from the following equation.

$$\text{Ratio of } I_{T1}=(I_{T1}-I_0)/(I_{10\%}-I_0)\times 100$$

<Method of Measuring Number-Average Particle Diameter of Core Fine Particles>

The number-average particle diameter of the core fine particles in the present disclosure was measured with Zetasizer Nano-ZS (manufactured by Malvern Instruments Ltd.) by preparing an aqueous dispersion liquid having a core fine particle concentration of 1.0 mass %.

Measurement conditions are as described below.

Cell: Quartz glass cell
Dispersant: Water (Dispersant RI: 1.330)
Temperature: 25° C.
Material RI: 1.60
Result Calculation: General Purpose According to the present disclosure, there can be provided a toner that has satisfactory fluidity and satisfactory transferability while securing fixability, and that hardly deteriorates even after multi-sheet printing.

The present disclosure is specifically described below by way of Examples. However, the present disclosure is not limited to these Examples. All of "part(s)" and "%" of materials in Examples and Comparative Examples are by mass, unless otherwise stated.

<Preparation of Organosilicon Compound Liquid 1>

| | |
|---|---|
| Ion-exchanged water | 90.0 parts |
| Ethyltrimethoxysilane | 10.0 parts |

The materials were weighed in a 200-milliliter beaker, and the pH of the mixture was adjusted to 4.0 with 1 mol/L hydrochloric acid. After that, the organosilicon compound was hydrolyzed by stirring the mixture for 1 hour while heating the mixture to 60° C. in a water bath. Thus, an organosilicon compound liquid 1 was prepared.

<Preparation of Organosilicon Compound Liquids 2 to 10>

Organosilicon compound liquids 2 to 10 were each prepared in the same manner as in the preparation of the organosilicon compound liquid 1 except that the kind of the organosilicon compound was changed as shown in Table 1 below.

TABLE 1

| | Organosilicon compound | Parts |
|---|---|---|
| Organosilicon compound liquid 1 | Ethyltrimethoxysilane | 10.0 |
| Organosilicon compound liquid 2 | Methyltrimethoxysilane | 10.0 |
| Organosilicon compound liquid 3 | Vinyltrimethoxysilane | 10.0 |
| Organosilicon compound liquid 4 | Propyltrimethoxysilane | 10.0 |
| Organosilicon compound liquid 5 | Isobutyltrimethoxysilane | 10.0 |
| Organosilicon compound liquid 6 | Hexyltrimethoxysilane | 10.0 |
| Organosilicon compound liquid 7 | Phenyltriethoxysilane | 10.0 |
| Organosilicon compound liquid 8 | 3-Methacryloxypropyltrimethoxysilane | 10.0 |
| Organosilicon compound liquid 9 | Dimethyldiethoxysilane | 10.0 |
| Organosilicon compound liquid 10 | Hexamethyldisilazane | 10.0 |

<Method of Producing Dispersion Liquid of Core Fine Particles 1>

| | |
|---|---|
| Core fine particles 1 (silica produced by a water glass method, number-average particle diameter: 105 nm) | 40.0 parts |
| Ion-exchanged water | 60.0 parts |

The materials were weighed and mixed, and then the mixture was subjected to dispersion treatment with a desktop ultrasonic cleaning and dispersing unit having an oscillatory frequency of 50 kHz and an electrical output of 150 W (product name: VS-150, manufactured by VELVO-CLEAR) for 5 minutes to provide a dispersion liquid of the core fine particles 1.

<Methods of Producing Dispersion Liquids of Core Fine Particles 2 to 12>

Dispersion liquids of core fine particles 2 to 12 were each obtained in the same manner as in the production of the dispersion liquid of the core fine particles 1 except that the kind of the core fine particles was changed as shown in Table 2.

TABLE 2

| | Kind | Particle diameter [nm] |
|---|---|---|
| Dispersion liquid of core fine particles 1 | Silica (water glass method) | 105 |
| Dispersion liquid of core fine particles 2 | Silica (sol-gel method) | 102 |
| Dispersion liquid of core fine particles 3 | Titanium oxide | 98 |
| Dispersion liquid of core fine particles 4 | Alumina | 106 |
| Dispersion liquid of core fine particles 5 | Acrylic resin | 101 |
| Dispersion liquid of core fine particles 6 | Silica (water glass method) | 11 |
| Dispersion liquid of core fine particles 7 | Silica (water glass method) | 33 |
| Dispersion liquid of core fine particles 8 | Silica (water glass method) | 49 |
| Dispersion liquid of core fine particles 9 | Silica (water glass method) | 214 |
| Dispersion liquid of core fine particles 10 | Silica (water glass method) | 302 |

TABLE 2-continued

| | Kind | Particle diameter [nm] |
|---|---|---|
| Dispersion liquid of core fine particles 11 | Silica (water glass method) | 521 |
| Dispersion liquid of core fine particles 12 | Silica (water glass method) | 750 |

<Method of Producing Dispersion Liquid of Fine Particles 13>

| | |
|---|---|
| Dispersion liquid of core fine particles 1 | 5.0 parts |
| Organosilicon compound liquid 1 | 40.0 parts |

A mixed liquid of the materials was prepared, and its pH was adjusted to 5.5. The mixed liquid was held for 1 hour while being stirred with a propeller stirring blade. After that, the pH was adjusted to 8.3 with a 1 mol/L aqueous solution of NaOH, and the resultant mixture was held for 4 hours while being stirred. After that, the mixture was repeatedly purified by centrifugation three times, and then 3.0 parts of ion-exchanged water was added thereto. The resultant was subjected to dispersion treatment with a desktop ultrasonic cleaning and dispersing unit having an oscillatory frequency of 50 kHz and an electrical output of 150 W (product name: VS-150, manufactured by VELVO-CLEAR) for 5 minutes to provide a dispersion liquid of fine particles 13.

<Method of Producing Fine Particles 14>

| | |
|---|---|
| Dispersion liquid of core fine particles 1 | 5.0 parts |
| Organosilicon compound liquid 10 | 40.0 parts |

A mixed liquid of the materials was prepared, and its pH was adjusted to 5.5. The mixed liquid was held for 1 hour while being stirred with a propeller stirring blade. After that, the pH was adjusted to 8.3 with a 1 mol/L aqueous solution of NaOH, and the resultant mixture was held for 4 hours while being stirred. After that, the mixture was purified by centrifugation three times to provide fine particles 14.

<Method of Producing Dispersion Liquid of Toner Base Particles 1>

(Step of Producing Aqueous Medium 1)

14.0 Parts of sodium phosphate (dodecahydrate) (manufactured by Rasa Industries, Ltd.) was loaded into 390.0 parts of ion-exchanged water in a reaction vessel, and the temperature of the mixture was held at 65° C. for 1.0 hour while the reaction vessel was purged with nitrogen. While the mixture was stirred with T.K. Homomixer (manufactured by Tokushu Kika Kogyo Co., Ltd.) at 12,000 rpm, an aqueous solution of calcium chloride obtained by dissolving 9.2 parts of calcium chloride (dihydrate) in 10.0 parts of ion-exchanged water was collectively loaded into the mixture. Thus, an aqueous medium containing a dispersion stabilizer was prepared. Further, 10% hydrochloric acid was loaded into the aqueous medium to adjust its pH to 6.0. Thus, an aqueous medium 1 was obtained.

(Step of Producing Polymerizable Monomer Composition)

| | |
|---|---|
| Styrene | 60.0 parts |
| C.I. Pigment Blue 15:3 | 6.5 parts |

The materials were loaded into an attritor (manufactured by Nippon Coke & Engineering Co., Ltd.), and were dispersed with zirconia particles each having a diameter of 1.7 mm at 220 rpm for 5.0 hours to prepare a dispersion liquid having dispersed therein a pigment.

The following materials were added to the dispersion liquid.

| | |
|---|---|
| Styrene | 20.0 parts |
| n-Butyl acrylate | 20.0 parts |
| Polyester resin (Tg: 75° C.) (condensate of bisphenol A propylene oxide 2.0 mol adduct/terephthalic acid/trimellitic acid) | 5.0 parts |
| Fischer-Tropsch wax (melting point: 78° C.) | 7.0 parts |

The temperature of the materials was kept at 65° C., and the materials were uniformly dissolved and dispersed with T.K. Homomixer (manufactured by Tokushu Kika Kogyo Co., Ltd.) at 500 rpm. Thus, a polymerizable monomer composition was prepared.

(Granulation Step)

While the temperature of the aqueous medium 1 was kept at 70° C. and the number of revolutions of a stirring apparatus was kept at 12,000 rpm, the polymerizable monomer composition was loaded into the aqueous medium 1, and 9.0 parts of t-butyl peroxypivalate serving as a polymerization initiator was added to the mixture. The resultant was granulated as it was with the stirring apparatus for 10 minutes while the number of revolutions was maintained at 12,000 rpm.

(Polymerization Step)

The stirring machine was changed from the high-speed stirring apparatus to a propeller stirring blade, and the granulated product was held at 70° C. and polymerized for 5.0 hours while being stirred at 150 rpm. A polymerization reaction was performed by increasing the temperature to 85° C. and heating the resultant at the temperature for 2.0 hours. Ion-exchanged water was added to adjust the concentration of toner base particles in the resultant dispersion liquid to 20.0%. Thus, a dispersion liquid of toner base particles 1 was obtained. The weight-average particle diameter (D4) of the toner base particles 1 was 6.7 μm.

<Method of Producing Dispersion Liquid of Toner Base Particles 2>

(Resin Particle Dispersion Liquid)

The following materials were weighed, and were mixed and dissolved.

| | |
|---|---|
| Styrene | 82.6 parts |
| n-Butyl acrylate | 9.2 parts |
| Acrylic acid | 1.3 parts |
| Hexanediol acrylate | 0.4 part |
| n-Lauryl mercaptan | 3.2 parts |

A 10% aqueous solution of NEOGEN RK (manufactured by DKS Co., Ltd.) was added to and dispersed in the solution. Further, while the resultant was slowly stirred for 10 minutes, an aqueous solution obtained by dissolving 0.15 part of potassium persulfate in 10.0 parts of ion-exchanged water was added thereto. After purging with nitrogen, the mixture was subjected to emulsion polymerization at a temperature of 70° C. for 6.0 hours. After the completion of the polymerization, the reaction liquid was cooled to room temperature, and ion-exchanged water was added thereto. Thus, a resin particle dispersion liquid having a solid content concentration of 12.5% and a median diameter on a volume basis of 0.2 μm was obtained.

(Wax Dispersion Liquid)

The following materials were weighed and mixed.

| | |
|---|---|
| Ester wax (melting point: 70° C.) | 100.0 parts |
| NEOGEN RK | 15.0 parts |
| Ion-exchanged water | 385.0 parts |

The mixture was dispersed with a wet jet mill JN100 (manufactured by Jokoh Co., Ltd.) for 1 hour to provide a wax dispersion liquid. The concentration of the wax dispersion liquid was 20.0%.

(Colorant Dispersion Liquid)

The following materials were weighed and mixed.

| | |
|---|---|
| C.I. Pigment Blue 15:3 | 100.0 parts |
| NEOGEN RK | 15.0 parts |
| Ion-exchanged water | 885.0 parts |

The mixture was dispersed with a wet jet mill JN100 (manufactured by Jokoh Co., Ltd.) for 1 hour to provide a colorant dispersion liquid.

| | |
|---|---|
| Resin particle dispersion liquid | 160.0 parts |
| Wax dispersion liquid | 10.0 parts |
| Colorant dispersion liquid | 10.0 parts |
| Magnesium sulfate | 0.2 part |

The materials were dispersed with a homogenizer (product name: ULTRA-TURRAX T50, manufactured by IKA), and then the resultant was warmed to 65° C. while being stirred. The resultant was stirred at 65° C. for 1.0 hour, and was then observed with an optical microscope. As a result, it was confirmed that aggregate particles having a number-average particle diameter of 6.0 μm were formed. 2.2 Parts of NEOGEN RK (manufactured by DKS Co., Ltd.) was added to the resultant, and then the temperature of the mixture was increased to 80° C., followed by stirring for 2.0 hours. Thus, fused spherical toner base particles were obtained. The mixture containing the toner base particles was cooled and then filtered. A solid separated by the filtration was washed with 720.0 parts of ion-exchanged water under stirring for 1.0 hour. The solution containing the toner base particles was filtered and dried with a vacuum dryer to provide toner base particles 2.

14.0 Parts of sodium phosphate (dodecahydrate) (manufactured by Rasa Industries, Ltd.) was loaded into 390.0 parts of ion-exchanged water in a vessel, and the temperature of the mixture was held at 65° C. for 1.0 hour while the vessel was purged with nitrogen.

While the mixture was stirred with T.K. Homomixer (manufactured by Tokushu Kika Kogyo Co., Ltd.) at 12,000 rpm, an aqueous solution of calcium chloride obtained by dissolving 9.2 parts of calcium chloride (dihydrate) in 10.0 parts of ion-exchanged water was collectively loaded into the mixture. Thus, an aqueous medium containing a dispersion stabilizer was prepared. Further, 10% hydrochloric acid was loaded into the aqueous medium to adjust its pH to 6.0. Thus, an aqueous medium was prepared.

100.0 Parts of the toner base particles 2 were loaded into the aqueous medium, and were dispersed at a temperature of 60° C. for 15 minutes while being rotated with T.K. Homomixer at 5,000 rpm. Ion-exchanged water was added to adjust the concentration of the toner base particles in the resultant dispersion liquid to 20.0%. Thus, a dispersion liquid of the toner base particles 2 was obtained. The weight-average particle diameter (D4) of the toner base particles 2 was 7.2 μm.

<Method of Producing Dispersion Liquid of Toner Base Particles 3>

660.0 Parts of ion-exchanged water and 25.0 parts of a 48.5% aqueous solution of sodium dodecyl diphenyl ether disulfonate were mixed and stirred, and the mixture was stirred with T.K. Homomixer (manufactured by Tokushu Kika Kogyo Co., Ltd.) at 10,000 rpm to prepare an aqueous medium.

The following materials were loaded into 500.0 parts of ethyl acetate, and were dissolved with a propeller-type stirring apparatus at 100 rpm to prepare a dissolved liquid.

| | |
|---|---|
| Styrene/butyl acrylate copolymer (copolymerization ratio: 80/20) | 100.0 parts |
| Saturated polyester resin (terephthalic acid-propylene oxide-modified bisphenol A copolymer) | 3.0 parts |
| C.I. Pigment Blue 15:3 | 6.5 parts |
| Fischer-Tropsch wax (melting point: 78° C.) | 9.0 parts |

Next, 150.0 parts of the aqueous medium was loaded into a vessel, and was stirred with T.K. Homomixer at a number of revolutions of 12,000 rpm. 100.0 Parts of the dissolved liquid was added to the aqueous medium, and the contents were mixed for 10 minutes to prepare an emulsified slurry.

After that, 100.0 parts of the emulsified slurry was loaded into a flask having set therein a tube for degassing, a stirring machine, and a temperature gauge. While being stirred at a stirring peripheral speed of 20 m/min, the slurry was desolvated at 30° C. for 12 hours under reduced pressure, and was aged at 45° C. for 4 hours to provide a desolvated slurry. After the desolvated slurry had been filtered under reduced pressure, 300.0 parts of ion-exchanged water was added to the resultant filter cake, and the contents were mixed and redispersed with T.K. Homomixer (at a number of revolutions of 12,000 rpm for 10 minutes), followed by filtration.

The resultant filter cake was dried with a dryer at 45° C. for 48 hours, and was sieved with a mesh having an aperture of 75 μm to provide toner base particles 3. The weight-average particle diameter (D4) of the toner base particles 3 was 6.9 μm.

14.0 Parts of sodium phosphate (dodecahydrate) (manufactured by Rasa Industries, Ltd.) was loaded into 390.0 parts of ion-exchanged water in a vessel, and the temperature of the mixture was held at 65° C. for 1.0 hour while the vessel was purged with nitrogen. While the mixture was stirred with T.K. Homomixer at 12,000 rpm, an aqueous solution of calcium chloride obtained by dissolving 9.2 parts of calcium chloride (dihydrate) in 10.0 parts of ion-exchanged water was collectively loaded into the mixture. Thus, an aqueous medium containing a dispersion stabilizer was prepared. Further, 10% hydrochloric acid was loaded into the aqueous medium to adjust its pH to 6.0. Thus, an aqueous medium was prepared.

100.0 Parts of the toner base particles 3 were loaded into the aqueous medium, and were dispersed at a temperature of 60° C. for 15 minutes while being rotated with T.K. Homomixer at 5,000 rpm. Ion-exchanged water was added to adjust the concentration of the toner base particles in the resultant dispersion liquid to 20.0%. Thus, a dispersion liquid of the toner base particles 3 was obtained.

<Method of Producing Dispersion Liquid of Toner Base Particles 4>

The following materials were weighed in a reaction tank including a cooling tube, a stirring machine, and a nitrogen-introducing tube.

| | |
|---|---|
| Terephthalic acid | 29.0 parts |
| Polyoxypropylene(2.2)-2,2-bis(4-hydroxyphenyl)propane | 80.0 parts |
| Titanium dihydroxybis(triethanol aminate) | 0.1 part |

After that, the mixture was heated to 200° C., and was subjected to a reaction for 9 hours while nitrogen was introduced into the tank and water to be produced was removed. Further, 5.8 parts of trimellitic anhydride was added to the resultant, and the mixture was heated to 170° C. and subjected to a reaction for 3 hours to synthesize a polyester resin.

In addition, the following materials were loaded into an autoclave, and the system was purged with $N_2$.

| | |
|---|---|
| Low-density polyethylene (melting point: 100° C.) | 20.0 parts |
| Styrene | 64.0 parts |
| n-Butyl acrylate | 13.5 parts |
| Acrylonitrile | 2.5 parts |

After that, while the mixture was increased in temperature and stirred, its temperature was held at 180° C. 50.0 Parts of a 2.0% solution of t-butyl hydroperoxide in xylene was continuously dropped into the system for 4.5 hours, and the resultant mixture was cooled. After that, the solvent was separated and removed. Thus, a graft polymer in which a copolymer was grafted to the polyethylene was obtained.

| | |
|---|---|
| Polyester resin | 100.0 parts |
| Paraffin wax (melting point: 75° C.) | 5.0 parts |
| Graft polymer | 5.0 parts |
| C.I. Pigment Blue 15:3 | 5.0 parts |

The materials were sufficiently mixed with Mitsui Henschel Mixer (Model FM-75, manufactured by Mitsui Miike Chemical Engineering Machinery Co., Ltd.), and then the mixture was melted and kneaded with a biaxial kneader (Model PCM-30, manufactured by Ikegai Iron Works, Ltd.) whose temperature had been set to 100° C. The resultant kneaded product was cooled and coarsely pulverized to 1 mm or less with a hammer mill to provide a coarsely pulverized product. Next, the resultant coarsely pulverized product was finely pulverized with TURBO MILL (T-250: RSS rotor/SNB liner) manufactured by Turbo Kogyo Co., Ltd. to provide a finely pulverized product having a size of about 5 μm. After that, fine and coarse powders were further cut with a multi-division classifier utilizing a Coanda effect. Thus, toner base particles 4 were obtained. The weight-average particle diameter (D4) of the toner base particles 4 was 6.4 μm.

14.0 Parts of sodium phosphate (dodecahydrate) (manufactured by Rasa Industries, Ltd.) was loaded into 390.0 parts of ion-exchanged water in a vessel, and the temperature of the mixture was held at 65° C. for 1.0 hour while the vessel was purged with nitrogen. While the mixture was stirred with T.K. Homomixer (manufactured by Tokushu Kika Kogyo Co., Ltd.) at 12,000 rpm, an aqueous solution of calcium chloride obtained by dissolving 9.2 parts of calcium chloride (dihydrate) in 10.0 parts of ion-exchanged water was collectively loaded into the mixture. Thus, an aqueous medium containing a dispersion stabilizer was prepared. Further, 10% hydrochloric acid was loaded into the aqueous medium to adjust its pH to 6.0. Thus, an aqueous medium was prepared.

200.0 Parts of the toner base particles 4 were loaded into the aqueous medium, and were dispersed at a temperature of 60° C. for 15 minutes while being rotated with T.K. Homomixer at 5,000 rpm. Ion-exchanged water was added to adjust the concentration of the toner base particles in the resultant dispersion liquid to 20.0%. Thus, a dispersion liquid of the toner base particles 4 was obtained.

<Method of Producing Toner Particles 1>

The following samples were weighed in a reaction vessel, and were mixed with a propeller stirring blade.

| | |
|---|---|
| Organosilicon compound liquid 1 | 40.0 parts |
| Dispersion liquid of core fine particles 1 | 5.0 parts |
| Dispersion liquid of toner base particles 1 | 500.0 parts |

Next, the pH of the mixed liquid was adjusted to 5.5. After the temperature of the mixed liquid had been set to 90° C., the mixed liquid was held for 1 hour while being stirred with a propeller stirring blade. After that, the pH was adjusted to 8.3 with a 1 mol/L aqueous solution of NaOH, and the resultant mixture was held for 4 hours while being stirred. After that, the mixture was air-cooled until its temperature became 25° C.

Diluted hydrochloric acid was added to the resultant mixed liquid to adjust its pH to 1.5, and then the whole was stirred for 2 hours, followed by filtration, water washing, and drying. Thus, toner particles 1 in each of which the fine particles were stuck to the toner base particle were obtained.

The fact that the fine particles were embedded in the surfaces of the toner base particles was confirmed by observation with a SEM, and the fact that the thickness of the condensation product of the organosilicon compound present on the surface of each of the toner base particles was 10 nm or less was confirmed by the result of the EDX mapping of a TEM image of a section of the toner base particle.

<Methods of Producing Toner Particles 2 to 33 and 39 to 43>

Toner particles 2 to 33 and 39 to 43 were each obtained in the same manner as in the method of producing the toner particles 1 except that the kinds and amounts of the organosilicon compound liquid and the dispersion liquid of the core fine particles, and the kind of the dispersion liquid of the toner base particles were changed as shown in Table 3.

The fact that the fine particles were embedded in the surfaces of the toner base particles was confirmed by observation with a SEM, and the fact that the thickness of the condensation product of the organosilicon compound present on the surface of each of the toner base particles was 10 nm or less was confirmed by the result of the EDX mapping of a TEM image of a section of the toner base particle.

TABLE 3

| | Organosilicon compound liquid | | Dispersion liquid of fine particles | | |
|---|---|---|---|---|---|
| | Kind | Amount [part(s)] | Kind | Amount [part(s)] | Dispersion liquid of toner base particles |
| Toner particles 1 | Organosilicon compound liquid 1 | 40.0 | Dispersion liquid of core fine particles 1 | 5.0 | Dispersion liquid of toner base particles 1 |
| Toner particles 2 | Organosilicon compound liquid 1 | 5.0 | Dispersion liquid of core fine particles 1 | 5.0 | Dispersion liquid of toner base particles 1 |
| Toner particles 3 | Organosilicon compound liquid 1 | 10.0 | Dispersion liquid of core fine particles 1 | 5.0 | Dispersion liquid of toner base particles 1 |
| Toner particles 4 | Organosilicon compound liquid 1 | 60.0 | Dispersion liquid of core fine particles 1 | 5.0 | Dispersion liquid of toner base particles 1 |
| Toner particles 5 | Organosilicon compound liquid 1 | 100.0 | Dispersion liquid of core fine particles 1 | 5.0 | Dispersion liquid of toner base particles 1 |
| Toner particles 6 | Organosilicon compound liquid 1 | 120.0 | Dispersion liquid of core fine particles 1 | 5.0 | Dispersion liquid of toner base particles 1 |
| Toner particles 7 | Organosilicon compound liquid 2 | 40.0 | Dispersion liquid of core fine particles 1 | 5.0 | Dispersion liquid of toner base particles 1 |
| Toner particles 8 | Organosilicon compound liquid 3 | 40.0 | Dispersion liquid of core fine particles 1 | 5.0 | Dispersion liquid of toner base particles 1 |
| Toner particles 9 | Organosilicon compound liquid 4 | 40.0 | Dispersion liquid of core fine particles 1 | 5.0 | Dispersion liquid of toner base particles 1 |
| Toner particles 10 | Organosilicon compound liquid 5 | 40.0 | Dispersion liquid of core fine particles 1 | 5.0 | Dispersion liquid of toner base particles 1 |
| Toner particles 11 | Organosilicon compound liquid 6 | 40.0 | Dispersion liquid of core fine particles 1 | 5.0 | Dispersion liquid of toner base particles 1 |
| Toner particles 12 | Organosilicon compound liquid 7 | 40.0 | Dispersion liquid of core fine particles 1 | 5.0 | Dispersion liquid of toner base particles 1 |
| Toner particles 13 | Organosilicon compound liquid 8 | 40.0 | Dispersion liquid of core fine particles 1 | 5.0 | Dispersion liquid of toner base particles 1 |
| Toner particles 14 | Organosilicon compound liquid 9 | 40.0 | Dispersion liquid of core fine particles 1 | 5.0 | Dispersion liquid of toner base particles 1 |
| Toner particles 15 | Organosilicon compound liquid 1 | 40.0 | Dispersion liquid of core fine particles 1 | 0.1 | Dispersion liquid of toner base particles 1 |
| Toner particles 16 | Organosilicon compound liquid 1 | 40.0 | Dispersion liquid of core fine particles 1 | 0.3 | Dispersion liquid of toner base particles 1 |
| Toner particles 17 | Organosilicon compound liquid 1 | 40.0 | Dispersion liquid of core fine particles 1 | 0.8 | Dispersion liquid of toner base particles 1 |
| Toner particles 18 | Organosilicon compound liquid 1 | 40.0 | Dispersion liquid of core fine particles 1 | 1.3 | Dispersion liquid of toner base particles 1 |
| Toner particles 19 | Organosilicon compound liquid 1 | 40.0 | Dispersion liquid of core fine particles 1 | 12.5 | Dispersion liquid of toner base particles 1 |
| Toner particles 20 | Organosilicon compound liquid 1 | 40.0 | Dispersion liquid of core fine particles 1 | 17.5 | Dispersion liquid of toner base particles 1 |
| Toner particles 21 | Organosilicon compound liquid 1 | 40.0 | Dispersion liquid of core fine particles 1 | 25.0 | Dispersion liquid of toner base particles 1 |
| Toner particles 22 | Organosilicon compound liquid 1 | 40.0 | Dispersion liquid of core fine particles 1 | 37.5 | Dispersion liquid of toner base particles 1 |
| Toner particles 23 | Organosilicon compound liquid 1 | 40.0 | Dispersion liquid of core fine particles 2 | 5.0 | Dispersion liquid of toner base particles 1 |
| Toner particles 24 | Organosilicon compound liquid 1 | 40.0 | Dispersion liquid of core fine particles 3 | 5.0 | Dispersion liquid of toner base particles 1 |
| Toner particles 25 | Organosilicon compound liquid 1 | 40.0 | Dispersion liquid of core fine particles 4 | 5.0 | Dispersion liquid of toner base particles 1 |
| Toner particles 26 | Organosilicon compound liquid 1 | 40.0 | Dispersion liquid of core fine particles 5 | 5.0 | Dispersion liquid of toner base particles 1 |
| Toner particles 27 | Organosilicon compound liquid 1 | 40.0 | Dispersion liquid of core fine particles 6 | 5.0 | Dispersion liquid of toner base particles 1 |
| Toner particles 28 | Organosilicon compound liquid 1 | 40.0 | Dispersion liquid of core fine particles 7 | 5.0 | Dispersion liquid of toner base particles 1 |
| Toner particles 29 | Organosilicon compound liquid 1 | 40.0 | Dispersion liquid of core fine particles 8 | 5.0 | Dispersion liquid of toner base particles 1 |
| Toner particles 30 | Organosilicon compound liquid 1 | 40.0 | Dispersion liquid of core fine particles 9 | 5.0 | Dispersion liquid of toner base particles 1 |
| Toner particles 31 | Organosilicon compound liquid 1 | 40.0 | Dispersion liquid of core fine particles 10 | 5.0 | Dispersion liquid of toner base particles 1 |
| Toner particles 32 | Organosilicon compound liquid 1 | 40.0 | Dispersion liquid of core fine particles 11 | 5.0 | Dispersion liquid of toner base particles 1 |
| Toner particles 33 | Organosilicon compound liquid 1 | 40.0 | Dispersion liquid of core fine particles 12 | 5.0 | Dispersion liquid of toner base particles 1 |
| Toner particles 39 | Organosilicon compound liquid 1 | 40.0 | Dispersion liquid of core fine particles 1 + Dispersion liquid of core fine particles 7 | 2.5 + 2.5 | Dispersion liquid of toner base particles 1 |
| Toner particles 40 | Organosilicon compound liquid 1 + Organosilicon compound liquid 2 | 20.0 + 20.0 | Dispersion liquid of core fine particles 1 | 5.0 | Dispersion liquid of toner base particles 1 |
| Toner particles 41 | Organosilicon compound liquid 1 | 40.0 | Dispersion liquid of core fine particles 1 | 5.0 | Dispersion liquid of toner base particles 2 |

TABLE 3-continued

| | Organosilicon compound liquid | | Dispersion liquid of fine particles | | |
|---|---|---|---|---|---|
| | Kind | Amount [part(s)] | Kind | Amount [part(s)] | Dispersion liquid of toner base particles |
| Toner particles 42 | Organosilicon compound liquid 1 | 40.0 | Dispersion liquid of core fine particles 1 | 5.0 | Dispersion liquid of toner base particles 3 |
| Toner particles 43 | Organosilicon compound liquid 1 | 40.0 | Dispersion liquid of fine particles 1 | 5.0 | Dispersion liquid of toner base particles 4 |

<Method of Producing Toner Particles 34>

Toner particles 34 were obtained in the same manner as in the method of producing the toner particles 1 except that: the amount of the organosilicon compound liquid 1 was changed to 120.0 parts; and the holding time after the pH and temperature of the mixed liquid had been set to 5.5 and 90° C., respectively was changed to 4 hours.

The fact that the fine particles were embedded in the surfaces of the toner base particles was confirmed by observation with a SEM, and the fact that the thickness of the condensation product of the organosilicon compound present on the surface of each of the toner base particles was 10 nm or less was confirmed by the result of the EDX mapping of a TEM image of a section of the toner base particle.

<Method of Producing Toner Particles 35>

Toner particles 35 were obtained in the same manner as in the method of producing the toner particles 1 except that: the amount of the organosilicon compound liquid 1 was changed to 120.0 parts; and the holding time after the pH and temperature of the mixed liquid had been set to 5.5 and 90° C., respectively was changed to 8 hours.

The fact that the fine particles were embedded in the surfaces of the toner base particles was confirmed by observation with a SEM, and the fact that the thickness of the condensation product of the organosilicon compound present on the surface of each of the toner base particles was 10 nm or less was confirmed by the result of the EDX mapping of a TEM image of a section of the toner base particle.

<Method of Producing Toner Particles 36>

The following samples were weighed in a reaction vessel, and were mixed with a propeller stirring blade.

| | |
|---|---|
| Organosilicon compound liquid 1 | 60.0 parts |
| Dispersion liquid of toner base particles 1 | 500.0 parts |

Next, the pH of the mixed liquid 1 was adjusted to 5.5. After the temperature of the mixed liquid had been set to 90° C., the mixed liquid was held for 4 hours while being stirred with a propeller stirring blade. After that, the following samples were added to the mixed liquid, and the whole was further held for 1 hour.

| | |
|---|---|
| Organosilicon compound liquid 1 | 60.0 parts |
| Dispersion liquid of core fine particles 1 | 5.0 parts |

After that, the pH of the resultant was adjusted to 8.3 with a 1 mol/L aqueous solution of NaOH, and the resultant mixture was held for 4 hours while being stirred. After that, the mixture was air-cooled until its temperature became 25° C. Diluted hydrochloric acid was added to the resultant mixed liquid to adjust its pH to 1.5, and then the whole was stirred for 2 hours, followed by filtration, water washing, and drying. Thus, toner particles 36 in each of which the fine particles were stuck to the toner base particle were obtained.

The fact that the fine particles were embedded in the surfaces of the toner base particles was confirmed by observation with a SEM, and the fact that the thickness of the condensation product of the organosilicon compound present on the surface of each of the toner base particles was 10 nm or less was confirmed by the result of the EDX mapping of a TEM image of a section of the toner base particle.

<Method of Producing Toner Particles 37>

Toner particles 37 were obtained in the same manner as in the method of producing the toner particles 36 except that the amount of the organosilicon compound liquid 1 to be added first and the amount of the organosilicon compound liquid 1 to be added together with the dispersion liquid of the core fine particles 1 were changed to 80.0 parts and 40.0 parts, respectively.

The fact that the fine particles were embedded in the surfaces of the toner base particles was confirmed by observation with a SEM, and the fact that the thickness of the condensation product of the organosilicon compound present on the surface of each of the toner base particles was 10 nm or less was confirmed by the result of the EDX mapping of a TEM image of a section of the toner base particle.

<Method of Producing Dispersion Liquid of Precursor of Toner Particles 38>

The process up to the granulation step was performed in the same manner as in the method of producing the dispersion liquid of the toner base particles 1 except that 10.0 parts of ethyltrimethoxysilane was added to the polymerizable monomer composition. Thus, a dispersion liquid of a precursor of toner particles 38 was obtained.

<Method of Producing Toner Particles 38>

The toner particles 38 were obtained in the same manner as in the method of producing the toner particles 1 except that the dispersion liquid of the toner base particles 1 was changed to the dispersion liquid of the precursor of the toner particles 38.

The fact that the fine particles were embedded in the surfaces of the toner base particles was confirmed by observation with a SEM. The result of the EDX mapping of a TEM image of a section of each of the toner base particles showed that the thickness of the condensation product of the organosilicon compound present on the surface of the toner base particle was from about 20 nm to about 30 nm.

<Method of Producing Comparative Toner Particles 1>

Comparative toner particles 1 were obtained in the same manner as in the method of producing the toner particles 1 except that the organosilicon compound liquid was not used. As a result of observation with a SEM, the fine particles were not embedded in the surfaces of the toner base particles.

<Method of Producing Comparative Toner Particles 2>

Comparative toner particles 2 were obtained in the same manner as in the method of producing the toner particles 1 except that the organosilicon compound liquid 1 was changed to the organosilicon compound liquid 10.

<Method of Producing Comparative Toner Particles 3>

Comparative toner particles 3 were obtained in the same manner as in the method of producing the toner particles 1 except that: the dispersion liquid of the core fine particles 1 was changed to the dispersion liquid of the core fine particles 13; and the organosilicon compound liquid 1 was not used.

<Method of Producing Dispersion Liquid of Precursor of Comparative Toner Particles 4>

The process up to the granulation step was performed in the same manner as in the method of producing the dispersion liquid of the toner base particles 1 except that 12.0 parts of ethyltrimethoxysilane was added to the polymerizable monomer composition. Thus, a dispersion liquid of a precursor of comparative toner particles 4 was obtained.

<Method of Producing Comparative Toner Particles 4>

The comparative toner particles 4 were obtained in the same manner as in the method of producing the toner particles 1 except that: the dispersion liquid of the toner base particles 1 was changed to the dispersion liquid of the precursor of the comparative toner particles 4; and the amount of the organosilicon compound liquid 1 was changed to 100.0 parts.

<Method of Producing Comparative Toner Particles 5>

Diluted hydrochloric acid was added to the dispersion liquid of the toner base particles 1 to adjust its pH to 1.5, and then the mixture was stirred for 2 hours, followed by filtration, water washing, and drying. Thus, a powder of the toner base particles 1 was obtained. Next, the following materials were added to the powder, and the mixture was stirred with Mitsui Henschel Mixer (manufactured by Mitsui Miike Chemical Engineering Machinery Co., Ltd.), in which the tip speed of a stirring blade had been set to 40 msec, for 5 minutes to provide comparative toner particles 5.

| | |
|---|---|
| Toner base particles 1 | 100.0 parts |
| Fine particles 14 | 2.0 parts |

<Method of Producing Comparative Toner Particles 6>

| | |
|---|---|
| Comparative toner particles 5 | 100.0 parts |
| Ion-exchanged water (pH: 4.0) | 300.0 parts |
| Aqueous solution of methylol melamine (product name: MIRBANE RESIN KAM-7, manufactured by Showa Denko K. K.) | 3.0 parts |
| Sodium acrylate (product name: JURYMER AC-103, manufactured by Toagosei Co., Ltd.) | 50.0 parts |
| Methylolated urea (product name: MIRBANE RESIN SUM-100, manufactured by Showa Denko K. K.) | 1.0 part |

A mixed liquid of the materials was prepared, and was stirred at a number of revolutions of 1,200 rpm. The temperature of the mixed solution was increased to 70° C., and was held for 1 hour. After that, the solution was cooled to normal temperature, and the resultant dispersion liquid was filtered, washed with water, and dried to provide comparative toner particles 6.

<Method of Producing Comparative Toner Particles 7>

| | |
|---|---|
| Toner base particles 1 | 30.0 parts |
| Ion-exchanged water | 81.0 parts |
| Methanol | 189.0 parts |

A mixed liquid of the materials was subjected to ultrasonic dispersion. Next, the following materials were added under a state in which the mixed liquid was stirred, and the whole was held at 50° C. for 5 hours.

| | |
|---|---|
| Dispersion liquid of core fine particles 1 | 5.0 parts |
| 0.4% solution of stearylamine acetate in methanol | 10.0 parts |

The resultant was cooled, and was then filtered, washed with water, and dried to provide a powder. The core fine particles 1 were embedded in and stuck to the surfaces of the toner base particles by pulverizing the powder in a ball mill containing alumina balls each having a diameter of 4 mm for 5 hours. The resultant was dispersed in 300.0 parts of a mixed liquid containing water and methanol at a ratio of 150 parts:150 parts. Further, 200.0 parts of the organosilicon compound liquid 1 was added to the dispersion liquid, and the mixture was held at 50° C. for 5 hours, followed by filtration and drying. Thus, comparative toner particles 7 were obtained.

The results of the evaluations of the toner particles 1 to 43 and the comparative toner particles 1 to 7 are shown in Table 4.

In Table 4, a case in which the embedment ratio of the fine particles fell within the range of from 20% or more to less than 80% was represented by "Y" in the column "Embedment judgment", and a case in which the embedment ratio deviated from the range was represented by "N". In addition, in the column "Confirmation of whether or not thickness is 10 nm or less", a case in which the thickness of the condensation product of the organosilicon compound was 10 nm or less was represented by "Y", a case in which the thickness was more than 10 nm was represented by "N", and a case in which the film of the condensation product of the organosilicon compound was absent was represented by "–".

TABLE 4

| | Embedment judgment | Coverage | Ratio of $I_{T1}$ | Confirmation of whether or not thickness is 10 nm or less |
|---|---|---|---|---|
| Toner particles 1 | Y | 8.2% | 98% | Y |
| Toner particles 2 | Y | 1.4% | 102% | Y |
| Toner particles 3 | Y | 0.2% | 99% | Y |
| Toner particles 4 | Y | 14.1% | 95% | Y |
| Toner particles 5 | Y | 23.8% | 100% | Y |
| Toner particles 6 | Y | 29.7% | 99% | Y |
| Toner particles 7 | Y | 8.6% | 101% | Y |
| Toner particles 8 | Y | 7.1% | 99% | Y |
| Toner particles 9 | Y | 7.7% | 98% | Y |
| Toner particles 10 | Y | 6.8% | 98% | Y |
| Toner particles 11 | Y | 7.9% | 97% | Y |
| Toner particles 12 | Y | 7.3% | 103% | Y |
| Toner particles 13 | Y | 6.7% | 96% | Y |
| Toner particles 14 | Y | 8.2% | 105% | Y |

TABLE 4-continued

| | Embedment judgment | Coverage | Ratio of $I_{T1}$ | Confirmation of whether or not thickness is 10 nm or less |
|---|---|---|---|---|
| Toner particles 15 | Y | 7.9% | 98% | Y |
| Toner particles 16 | Y | 8.0% | 99% | Y |
| Toner particles 17 | Y | 7.5% | 101% | Y |
| Toner particles 18 | Y | 6.9% | 100% | Y |
| Toner particles 19 | Y | 8.2% | 101% | Y |
| Toner particles 20 | Y | 8.1% | 99% | Y |
| Toner particles 21 | Y | 7.4% | 98% | Y |
| Toner particles 22 | Y | 7.2% | 100% | Y |
| Toner particles 23 | Y | 7.4% | 100% | Y |
| Toner particles 24 | Y | 8.5% | 101% | Y |
| Toner particles 25 | Y | 8.1% | 97% | Y |
| Toner particles 26 | Y | 8.3% | 101% | Y |
| Toner particles 27 | Y | 8.9% | 99% | Y |
| Toner particles 28 | Y | 7.8% | 101% | Y |
| Toner particles 29 | Y | 7.1% | 100% | Y |
| Toner particles 30 | Y | 7.6% | 100% | Y |
| Toner particles 31 | Y | 7.9% | 102% | Y |
| Toner particles 32 | Y | 8.3% | 99% | Y |
| Toner particles 33 | Y | 8.2% | 99% | Y |
| Toner particles 34 | Y | 29.3% | 76% | Y |
| Toner particles 35 | Y | 29.6% | 67% | Y |
| Toner particles 36 | Y | 31.0% | 50% | Y |
| Toner particles 37 | Y | 34.4% | 36% | Y |
| Toner particles 38 | Y | 39.7% | 37% | N (20 nm to 30 nm) |
| Toner particles 39 | Y | 8.3% | 99% | Y |
| Toner particles 40 | Y | 8.8% | 100% | Y |
| Toner particles 41 | Y | 7.4% | 101% | Y |
| Toner particles 42 | Y | 8.6% | 100% | Y |
| Toner particles 43 | Y | 7.6% | 99% | Y |
| Comparative toner particles 1 | N | 0.0% | 100% | — |
| Comparative toner particles 2 | Y | 0.1% | 100% | Y |
| Comparative toner particles 3 | Y | 0.0% | 101% | — |
| Comparative toner particles 4 | Y | 61.1% | 17% | N (30 nm or more) |
| Comparative toner particles 5 | Y | 0.0% | 99% | — |
| Comparative toner particles 6 | Y | 0.0% | 28% | — |
| Comparative toner particles 7 | Y | 51.9% | 26% | Y |

The toner particles 1 to 43 and the comparative toner particles 1 to 7 were defined as toners 1 to 43 and comparative toners 1 to 7, respectively, and were used in Examples and Comparative Examples.

<Method of Producing Toner 44>100.0 Parts of the toner particles 1 were mixed with 0.5 part of hydrophobic silica having a specific surface area based on a BET method of 210 $m^2/g$ whose surface had been subjected to hydrophobic treatment with 4 mass % of hexamethyldisilazane and 3 mass % of a silicon oil having a viscosity of 100 cps, and 0.2 part of aluminum oxide having a specific surface area based on the BET method of 70 $m^2/g$ by using Mitsui Henschel Mixer (manufactured by Mitsui Miike Chemical Engineering Machinery Co., Ltd.). Thus, a toner 44 was obtained. The toner 44 was used as Example 44.

Example 1

A color laser printer (product name: LBP-7700C, manufactured by Canon Inc.) was used, and the toner of its cyan cartridge was removed, followed by the loading of 120 g of the toner 1 into the cartridge. The evaluations of the durability, fixability, solid followability, and transferability of the toner were performed by using the cartridge after the loading. The results are shown in Table 5.

<Durability Evaluation>

The cartridge was mounted on the cyan station of the printer, and a chart having a printing ratio of 2% was continuously printed on 8,000 sheets of A4 plain paper (product name: Office 70, Canon Marketing Japan Inc., 70 $g/m^2$) under normal temperature and normal humidity (23° C., 60% RH). After that, a solid image was printed, and its image density was evaluated. With regard to the image density, the image density of the fixed image portion of the output image was measured with a Macbeth densitometer (product name: RD-914, manufactured by Macbeth) mounted with an SPI auxiliary filter.

A: 1.45 or more

B: 1.40 or more and less than 1.45

C: 1.30 or more and less than 1.40

D: Less than 1.30

<Fixability Evaluation>

A fixation rubbing test was performed as a fixability evaluation. An image having many 3-dot and 3-space (600 dpi) images for density measurement each measuring 10 mm by 10 mm was output on A4 high white paper (product name: GF-C104, Canon Marketing Japan Inc., 104 $g/m^2$) after a toner mass per unit area had been adjusted to 0.5 $mg/cm^2$. The resultant fixed image was rubbed with lens-cleaning paper having applied thereto a load of 50 $g/cm^2$ (0.49 $N/cm^2$) five times, and the reduction ratio of its image density after the rubbing was evaluated based on the following. At the time of the outputting of the image, a process speed was set to 330 mm/sec by changing the gear and software of the main body of the evaluation machine, and a fixation temperature was set to 180° C.

In addition, a Macbeth reflection densitometer (manufactured by Macbeth) was used in the measurement of the image density. The reduction ratio of the image density after the rubbing was calculated by measuring a density relative to an image printed out in a white ground portion having an image density of 0.00.

A: Less than 2.0%
B: 2.0% or more and less than 5.0%
C: 5.0% or more and less than 10.0%
D: 10.0% or more <Solid Followability Evaluation>

With regard to the solid followability evaluation, a solid image (toner laid-on level: 0.40 mg/cm$^2$) is continuously printed on 3 sheets of A4 plain paper (product name: Office 70, Canon Marketing Japan Inc., 70 g/m$^2$), and a difference (density A-density B) between the density of the first sheet (density A) and the density of the third sheet (density B) is determined. A state in which the difference "density A-density B" is smaller means that the solid followability of the toner is more satisfactory, that is, the toner is more excellent in fluidity. The solid followability (density A-density B) was evaluated in accordance with the following criteria. The solid followability evaluation was performed at an initial stage and after multi-sheet printing (after printing on 8,000 sheets).

With regard to the image density, the image density of the fixed image portion of the output image was measured with a Macbeth densitometer (product name: RD-914, manufactured by Macbeth) mounted with an SPI auxiliary filter.

A: 0.00 or more and less than 0.05
B: 0.05 or more and less than 0.10
C: 0.10 or more and less than 0.15
D: 0.15 or more <Transferability (Transfer Efficiency)>

With regard to the transferability evaluation, a solid image (toner laid-on level: 0.40 mg/cm$^2$) was output on A4 plain paper (product name: Office 70, Canon Marketing Japan Inc., 70 g/m$^2$) at a process speed of 240 mm/sec. The apparatus was stopped during the transfer of the image from a photosensitive member to an intermediate transfer member, and a toner laid-on level M1 (mg/cm$^2$) on the photosensitive member before the transfer step and a toner laid-on level M2 (mg/cm$^2$) on the photosensitive member after the transfer step were measured. The transfer efficiency of the toner was calculated from the following equation by using the resultant toner laid-on levels.

$$\text{Transfer efficiency (\%)}=(M1-M2)/M1\times 100$$

The transferability was evaluated by the following evaluation criteria. The transferability evaluation was performed on the initial toner and after multi-sheet printing (after printing on 8,000 sheets).

A: Transfer efficiency of 95% or more
B: Transfer efficiency of 90% or more and less than 95%
C: Transfer efficiency of 85% or more and less than 90%
D: Transfer efficiency of less than 85%

Examples 2 to 44

The toners 2 to 44 were evaluated in the same manner as in Example 1. The results are shown in Table 5.

Comparative Examples 1 to 7

The comparative toners 1 to 7 were evaluated in the same manner as in Example 1. The results are shown in Table 5.

TABLE 5

| Example/ Comparative Example | Toner | Durability | | Fixability | | Solid followability: Initial stage | | Solid followability: After printing on 8,000 sheets | | Transferability: Initial stage | | Transferability: After printing on 8,000 sheets | |
|---|---|---|---|---|---|---|---|---|---|---|---|---|---|
| Example 1 | Toner 1 | A | 1.52 | A | 0.5% | A | 0.02 | A | 0.02 | A | 98% | A | 98% |
| Example 2 | Toner 2 | B | 1.43 | A | 0.6% | A | 0.02 | A | 0.02 | A | 98% | A | 98% |
| Example 3 | Toner 3 | A | 1.48 | A | 0.5% | A | 0.01 | A | 0.02 | A | 98% | A | 97% |
| Example 4 | Toner 4 | A | 1.52 | A | 1.1% | A | 0.02 | A | 0.02 | A | 98% | A | 98% |
| Example 5 | Toner 5 | A | 1.53 | A | 1.7% | A | 0.02 | A | 0.01 | A | 98% | A | 98% |
| Example 6 | Toner 6 | A | 1.54 | B | 2.6% | A | 0.02 | A | 0.02 | A | 99% | A | 98% |
| Example 7 | Toner 7 | A | 1.53 | A | 0.6% | A | 0.02 | A | 0.02 | A | 98% | A | 98% |
| Example 8 | Toner 8 | A | 1.51 | A | 0.5% | A | 0.02 | A | 0.02 | A | 99% | A | 98% |
| Example 9 | Toner 9 | A | 1.52 | A | 0.5% | A | 0.02 | A | 0.02 | A | 98% | A | 98% |
| Example 10 | Toner 10 | A | 1.52 | A | 0.5% | A | 0.02 | A | 0.01 | A | 98% | A | 98% |
| Example 11 | Toner 11 | A | 1.53 | A | 0.4% | A | 0.02 | A | 0.02 | A | 98% | A | 97% |
| Example 12 | Toner 12 | A | 1.52 | A | 0.5% | A | 0.02 | A | 0.02 | A | 98% | A | 98% |
| Example 13 | Toner 13 | A | 1.51 | A | 0.6% | A | 0.02 | A | 0.02 | A | 98% | A | 98% |
| Example 14 | Toner 14 | A | 1.52 | A | 0.5% | A | 0.02 | A | 0.02 | A | 98% | A | 98% |
| Example 15 | Toner 15 | A | 1.52 | A | 0.5% | C | 0.12 | C | 0.13 | C | 89% | C | 88% |
| Example 16 | Toner 16 | A | 1.52 | A | 0.5% | B | 0.07 | B | 0.07 | B | 93% | B | 92% |
| Example 17 | Toner 17 | A | 1.53 | A | 0.4% | A | 0.03 | A | 0.04 | A | 96% | A | 96% |
| Example 18 | Toner 18 | A | 1.52 | A | 0.6% | A | 0.02 | A | 0.02 | A | 99% | A | 98% |
| Example 19 | Toner 19 | A | 1.51 | A | 1.1% | A | 0.02 | A | 0.02 | A | 98% | A | 98% |
| Example 20 | Toner 20 | A | 1.53 | B | 2.4% | A | 0.01 | A | 0.02 | A | 98% | A | 98% |
| Example 21 | Toner 21 | A | 1.52 | B | 3.6% | A | 0.02 | A | 0.02 | A | 98% | A | 98% |
| Example 22 | Toner 22 | A | 1.52 | C | 5.1% | A | 0.02 | A | 0.02 | A | 98% | A | 98% |
| Example 23 | Toner 23 | A | 1.52 | A | 0.6% | A | 0.02 | A | 0.02 | A | 99% | A | 98% |
| Example 24 | Toner 24 | A | 1.52 | A | 0.5% | A | 0.02 | A | 0.01 | A | 98% | A | 97% |
| Example 25 | Toner 25 | A | 1.53 | A | 0.5% | A | 0.02 | A | 0.02 | A | 98% | A | 98% |
| Example 26 | Toner 26 | A | 1.52 | A | 0.4% | A | 0.02 | C | 0.12 | A | 98% | C | 88% |
| Example 27 | Toner 27 | A | 1.52 | A | 0.4% | A | 0.02 | A | 0.02 | C | 87% | C | 86% |
| Example 28 | Toner 28 | A | 1.52 | A | 0.4% | A | 0.02 | A | 0.02 | B | 92% | B | 91% |
| Example 29 | Toner 29 | A | 1.52 | A | 0.6% | A | 0.02 | A | 0.02 | A | 96% | A | 96% |
| Example 30 | Toner 30 | A | 1.52 | A | 0.5% | A | 0.02 | A | 0.02 | A | 98% | A | 98% |
| Example 31 | Toner 31 | A | 1.53 | A | 0.5% | A | 0.04 | A | 0.04 | A | 98% | A | 98% |
| Example 32 | Toner 32 | A | 1.53 | A | 0.5% | B | 0.08 | B | 0.08 | A | 98% | A | 98% |
| Example 33 | Toner 33 | A | 1.53 | A | 0.4% | C | 0.11 | C | 0.11 | A | 98% | A | 98% |
| Example 34 | Toner 34 | A | 1.52 | B | 2.9% | A | 0.02 | A | 0.02 | A | 99% | A | 98% |
| Example 35 | Toner 35 | A | 1.52 | B | 3.8% | A | 0.02 | A | 0.01 | A | 98% | A | 97% |
| Example 36 | Toner 36 | A | 1.52 | B | 4.9% | A | 0.01 | A | 0.02 | A | 98% | A | 98% |
| Example 37 | Toner 37 | A | 1.51 | C | 7.2% | A | 0.02 | A | 0.02 | A | 98% | A | 98% |

TABLE 5-continued

| Example/ Comparative Example | Toner | Durability | | Fixability | | Solid followability: Initial stage | | Solid followability: After printing on 8,000 sheets | | Transferability: Initial stage | | Transferability: After printing on 8,000 sheets | |
|---|---|---|---|---|---|---|---|---|---|---|---|---|---|
| Example 38 | Toner 38 | A | 1.53 | C | 9.5% | A | 0.02 | A | 0.02 | A | 99% | A | 98% |
| Example 39 | Toner 39 | A | 1.51 | A | 0.4% | A | 0.02 | A | 0.02 | A | 98% | A | 98% |
| Example 40 | Toner 40 | A | 1.52 | A | 0.5% | A | 0.02 | A | 0.02 | A | 98% | A | 97% |
| Example 41 | Toner 41 | A | 1.52 | A | 0.5% | A | 0.02 | A | 0.02 | A | 98% | A | 98% |
| Example 42 | Toner 42 | A | 1.53 | A | 0.5% | A | 0.02 | A | 0.02 | A | 98% | A | 98% |
| Example 43 | Toner 43 | A | 1.52 | A | 0.5% | A | 0.01 | A | 0.02 | A | 98% | A | 98% |
| Example 44 | Toner 44 | A | 1.52 | A | 0.6% | A | 0.02 | A | 0.02 | A | 98% | A | 98% |
| Comparative Example 1 | Comparative toner 1 | D | 1.17 | A | 0.5% | A | 0.02 | D | 0.23 | A | 98% | D | 78% |
| Comparative Example 2 | Comparative toner 2 | D | 1.19 | A | 0.4% | A | 0.02 | D | 0.24 | A | 98% | D | 76% |
| Comparative Example 3 | Comparative toner 3 | D | 1.2 | A | 0.5% | A | 0.02 | D | 0.23 | A | 98% | D | 79% |
| Comparative Example 4 | Comparative toner 4 | A | 1.54 | D | 10.3% | A | 0.02 | A | 0.02 | A | 99% | A | 98% |
| Comparative Example 5 | Comparative toner 5 | D | 1.21 | A | 0.4% | A | 0.02 | D | 0.23 | A | 98% | D | 77% |
| Comparative Example 6 | Comparative toner 6 | D | 1.2 | D | 12.0% | A | 0.02 | D | 0.24 | A | 98% | D | 78% |
| Comparative Example 7 | Comparative toner 7 | D | 1.28 | D | 13.6% | A | 0.02 | D | 0.19 | A | 98% | D | 82% |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-096222, filed May 15, 2017, which is hereby incorporated by reference herein in its entirety.

What is claimed is:

1. A toner, comprising a toner particle containing:

a toner base particle and a fine particle, the fine particle being a composite particle comprising a core fine particle and a first condensation product of a first organosilicon compound, the fine particle being stuck in a state of being partially embedded in a surface of the toner base particle, wherein the toner particle has a protrusion derived from the fine particle, a surface of the core fine particle is covered with the first condensation product, the surface of the toner base particle where the fine particle is not stuck is covered with a second condensation product of a second organosilicon compound, a coverage of the second condensation product with respect to the surface of the toner base particle where the fine particle is not stuck is from 0.1 to 40.0% by area, as calculated from a binary processed image of a backscattered electron image of the toner particle, the backscattered electron image being obtained with a scanning electron microscope, and each of the first organosilicon compound and the second organosilicon compound is at least one compound independently selected from the group consisting of compounds represented by the formula (1) and formula (2):

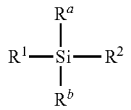

(1)

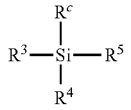

(2)

where $R^a$, $R^b$ and $R^c$ independently represent an alkyl group, an alkenyl group, an acetoxy group, an acyl group, an aryl group, a acryloxyalkyl group or a methacryloxyalkyl group, and $R^1$, $R^2$, $R^3$, $R^4$and $R^5$ independently represent a halogen atom, a hydroxy group or an alkoxy group.

2. A toner according to claim 1, wherein the toner base particle contains a binder resin, and in heating IR measurement of the toner base particle in a range of from 25° C. to 100° C., 50>$(I_{T1}-I_0)/(I_{10\%}-I_0)\times 100$ when $I_0$ is a peak intensity derived from the binder resin at 25° C. $I_{MAX}$ is a maximum value of the peak intensity derived from the binder resin, $T_1$ is a temperature at an intensity no % at which the peak intensity derived from the binder resin becomes 10% with respect to the $I_{MAX}$ and $I_{T1}$ is a peak intensity derived from the binder resin at the temperature $T_1$ when the toner is subjected to heating IR measurement.

3. A toner according to claim 1, wherein the core fine particle has a number-average particle diameter of 30 to 500 nm.

4. A toner according to claim 1, wherein the core fine particle is an inorganic fine particle.

5. A toner according to claim 1, wherein a content of the core fine particle is 0.1 to 10.0 parts by mass with respect to 100 parts by mass of the toner base particle.

* * * * *